US008580039B2

(12) United States Patent
Saeki et al.

(10) Patent No.: US 8,580,039 B2
(45) Date of Patent: Nov. 12, 2013

(54) SURFACE TREATMENT METHOD OF METAL MEMBER AND CLEANING NOZZLE

(75) Inventors: Tomonori Saeki, Yokosuka (JP); Yoshiyuki Ando, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 336 days.

(21) Appl. No.: 12/872,582

(22) Filed: Aug. 31, 2010

(65) Prior Publication Data

US 2011/0048454 A1 Mar. 3, 2011

(30) Foreign Application Priority Data

Aug. 31, 2009 (JP) ..... 2009-199991
Feb. 16, 2010 (JP) ..... 2010-031473
May 13, 2010 (JP) ..... 2010-110711

(51) Int. Cl.
*C23G 1/24* (2006.01)

(52) U.S. Cl.
USPC ..... 134/2; 134/15; 134/21; 134/26; 134/30; 134/31; 134/34; 134/35; 134/36; 134/37; 134/40; 134/42

(58) Field of Classification Search
USPC ..... 134/2, 15, 21, 26, 30, 31, 34, 35, 36, 134/37, 40, 42
See application file for complete search history.

(56) References Cited

U.S. PATENT DOCUMENTS 2,023,496 A * 12/1935 Todd ..... 134/22.19
4,141,373 A * 2/1979 Kartanson et al. ..... 75/403
5,370,143 A * 12/1994 Takahashi ..... 134/105
5,674,827 A * 10/1997 Kawashima et al. ..... 510/365
5,918,817 A 7/1999 Kanno et al.
6,129,100 A 10/2000 Kitagawa et al.
6,610,168 B1 8/2003 Miki et al.
2003/0217762 A1 11/2003 Kobayashi et al.
2004/0099284 A1 5/2004 Miki et al.
2007/0141849 A1 6/2007 Kanno et al.

FOREIGN PATENT DOCUMENTS

JP A-10-092707 4/1998
JP A-10-156229 6/1998
JP B1-2959763 7/1999
JP A-2000-68243 3/2000
JP A-2000-317410 11/2000
JP A-2001-250773 9/2001
JP A-2003-154205 5/2003
JP A-2003-249474 9/2003

(Continued)

OTHER PUBLICATIONS

"Readily available cleaning technique" (Kogyo Chosakai Publishing Co., Ltd.,2001, p. 141, p. 267, together with partial translation.

*Primary Examiner* — Bibi Carrillo
(74) *Attorney, Agent, or Firm* — Scully, Scott, Murphy & Presser, P.C.

(57) ABSTRACT

A surface treatment method of a metal member according to an embodiment of the invention includes removing an oily substance on the metal member by using gas-liquid two fluids that are obtained by boiling heated and pressured water under ordinary pressure. A surface treatment device of a metal member for removing an oily substance on the metal member includes self-generation two fluids production means for producing gas-liquid two fluids by boiling heated and pressured water under ordinary pressure, and a surface treatment room carrying out a surface treatment by bringing the self-generation two fluids into contact with the metal member.

8 Claims, 12 Drawing Sheets

(56) References Cited

FOREIGN PATENT DOCUMENTS

| | | |
|---|---|---|
| JP | B2-3498837 | 12/2003 |
| JP | A-2004-356285 | 12/2004 |
| JP | A-2005-109112 | 4/2005 |
| JP | A-2005-294819 | 10/2005 |
| JP | A-2006-255603 | 9/2006 |
| JP | B2-3860139 | 9/2006 |
| JP | A-2007-216158 | 8/2007 |

* cited by examiner

1a METAL STRIP
21 SURFACE TREATMENT ROOM
101 SELF-GENERATION TWO FLUIDS NOZZLE
120 WATER PRESSURE-HEAT APPLYING MEANS

1a METAL STRIP
21 SURFACE TREATMENT ROOM
101 SELF-GENERATION TWO FLUIDS NOZZLE
120 WATER PRESSURE-HEAT APPLYING MEANS 601,611 CLEANING NOZZLE
602 ORIFICE PART
603 EXPANDED DIAMETER PART
604 RECTIFYING PART
605 FORWARD END PART OF NOZZLE
606 OUTLET

SURFACE TREATMENT METHOD OF METAL MEMBER AND CLEANING NOZZLE

The present application is based on Japanese patent application Nos. 2009-199991, 2010-031473 and 2010-110711 filed on Aug. 31, 2009, Feb. 16, 2010 and May 13, 2010, respectively, the entire contents of which are incorporated herein by reference.

BACKGROUND OF THE INVENTION

1. Field of the Invention

This invention relates to a surface treatment method of a metal member including copper and a surface treatment device, and in particular, this invention relates to a surface treatment method of a metal member and a surface treatment device at the time of manufacturing the metal member such as a strip material, a wire material.

In addition, this invention relates to a cleaning technique capable of enhancing a cleaning degree of surfaces of various solid substances, for example, from a metal to which a mechanical processing is applied, such as a rolled steel plate, a cutting-worked product, to a semiconductor wafer to which a dry etching process is applied, and in particular, this invention relates to a cleaning nozzle that can be appropriately used for a degreasing cleaning of a metal strip and a metal plate including copper after the mechanical processing and a cleaning method of a surface of a solid substance using the cleaning nozzle and a cleaning device.

2. Description of the Related Art

A method of manufacturing a metal stripe including a copper stripe and a metal wire including a copper wire include a method that a raw material copper wire is processed so as to have a predetermined cross-section shape by a cold rolling, and then an extraneous matter on a surface thereof is removed from the surface by a cleaning treatment. The extraneous matter on the surface includes a lubricating oil used for a rolling process and a metal powder (a copper powder) that occurs in the rolling process.

FIG. 13 is an explanatory view schematically showing a conventional surface treatment device of a metal material, in which a metal strip 1*a* from a metal strip reel 1 before cleaning is fed from an uncoiler 11, and the metal strip 1*a* is passed through a surface treatment room 21 for cleaning so that a surface of the metal strip 1*a* is cleaned and an extraneous matter on the surface of the metal strip 1*a* is removed, and the metal strip 1*a* is dried in the drying treatment room and then is wound by a reel 2 of an uncoiler 12.

Conventionally, as a method of removing the extraneous matter in the surface treatment room 21, there is a technique (related art 1) that a lubricating oil on an object to be cleaned is removed by immersing the object in an organic solvent so as to dissolve the lubricating oil in the solvent, for example, as disclosed in non-patent literature 1. The non-patent literature "Readily available cleaning technique" also discloses a technique (related art 2) that a fine particle is removed by irradiating an object to be cleaned with an ultrasonic wave in a liquid.

In addition, there is a technique (related art 3) that a two fluids spray is sprayed, for example, this technique is disclosed in patent literatures 1 to 6. Also, there is a technique (related art 4) that a two fluids spray formed of water vapor and water liquid is used, for example, this technique is disclosed in patent literatures 7 to 9. Also, there is a technique (related art 5) that water vapor and spray water are discharged into a surface to be processed, for example, this technique is disclosed in patent literature 10. Also, there is a technique (related art 6) that a high pressure jet is used, for example, this technique is disclosed in a patent literature 11. These techniques are used in combination as necessary.

Patent literature 1: JP-B-2959763
Patent literature 2: JP-B-3498837
Patent literature 3: JP-A-1998-156229
Patent literature 4: JP-A-2005-294819
Patent literature 5: JP-A-2005-109112
Patent literature 6: JP-A-2006-255603
Patent literature 7: JP-B-3860139
Patent literature 8: JP-A-2001-250773
Patent literature 9: JP-A-2003-249474
Patent literature 10: JP-A-2007-216158
Patent literature 11: JP-A-1998-92707
Patent literature 12: JP-A-2003-154205
Non-patent literature 1 "Readily available cleaning technique" (Kogyo Chosakai Publishing Co., Ltd., 2001, p. 262, p. 138)

A problem with the related art 1 is that there is a possibility that in accordance with volatilization of the organic solvent, a working environment contamination and an air pollution are caused.

According to an Air Pollution Control Law revised in 2005, it requires to reduce a volatile organic compound (hereinafter referred to as VOC) generation amount by 30% from 2000 levels by the year 2010.

The copper strip and the copper wire have a long length as a whole, and even if they are wound around a reel or the like, the reel can not help having a large diameter and width, so that it is difficult to house the whole materials in a sealed device.

Due to this, generally, the reel of the copper strip or the copper wire is disposed in a feeding device located at outside of the sealed device, and the copper strip or the copper wire is introduced into the inside of the sealed device from an inlet so as to be processed, and then it is fed to outside of the sealed device from an outlet, so that it is wound around a new reel by a winding device or the like located at outside of the sealed device.

Namely, as explained in FIG. 13, the inside of the surface treatment room 21 is communicated with atmosphere via at least two open parts of the inlet and the outlet, so that the surface treatment room 21 can not be sealed. Consequently, in order to recover the organic solvent, it is necessary to introduce an equipment that is capable of sucking in such a large air volume that the organic solvent does not leak from the open parts, and further, a new problem is caused, that the organic solvent recovered is needed to be treated by a treating operation.

In case of using water instead of using the organic solvent in order to solve the above-mentioned problem, a new problem is caused, that a surface of the metal is oxidized. When a surface of the metal material including copper is oxidized, problems are caused in subsequent processes, that for example, in a coating process of resin, an adhesion between the resin and the metal is reduced, and in a plating process, holes referred to as a pit are generate.

A problem with the related art 2 is that cleaning power is not sufficiently high. When an output of the ultrasonic wave is increased in order to enhance the cleaning power, new problems are caused, that possibility that an ultrasonic wave oscillator is broken is heightened and cost for keeping the device is increased.

A problem with the related art 3 is that when gas and liquid are brought contact with each other, due to this, the liquid evaporates and a temperature is lowered by that an evaporative latent heat is removed. Generally, since the higher the temperature is, the more the viscosity of the liquid is lowered, similarly, the higher the temperature is, the faster the diffusion speed of contaminant into the cleaning liquid is. Consequently, in order to heighten the cleaning power, it is effective that the temperature of the cleaning liquid is heightened, but in case of using the related art 3, it is difficult to heighten the temperature. In addition, there is a problem that a large quantity of gas is consumed, so that a gas discharge equipment is needed to be increased in size.

A problem with the related arts 4 and 5 is that the cleaning power is insufficient. Any of the patent literatures 7 to 10 does not disclose removal of an oily liquid such as a rolling process oil adhering to the metal material. The patent literatures 8 and 9 disclose a removing method of a resist, and taking it for example, the minimum time necessary for the removal is read as not less than 30 seconds, for example, from FIG. 5 of the patent literature 9, but generally, a metal strip including a copper strip as an object to be cleaned is subjected to the cleaning treatment while being moved at a speed that is more than 10 m/min in case of a low speed and is more than 100 m/min in case of a high speed. If the cleaning time of 30 seconds is needed, it is necessary that a length of a cleaning zone is at least 5 m, so that the equipment is needed to be increased in size and an increase in investment is brought.

A problem with the related art 6 is that a large-scale device is needed. The patent literature 11 discloses a method of discharging a cleaning liquid pressured to not less than 5 MPa toward a surface to be cleaned, but a large-scale equipment for pressuring up to the above-mentioned pressure is needed, and a plant and equipment investment is increased.

In addition, a metallic product such as a steel plate, a screw material, a gear, a copper strip, a copper foil, a copper wire is manufactured by a mechanical processing such as a rolling work, a cutting work, a drawing work, and is formed so as to have a predetermined cross-section shape, and then an extraneous matter on the surface thereof is removed by a cleaning treatment. The extraneous matter on the surface includes a lubricating oil used for processing and a metal powder that occurs in the processing.

In addition, a wafer when a semiconductor device is manufactured, and a glass substrate (a glass substrate for liquid crystal) on which electric parts for driving a liquid crystal element are formed are processed by forming a thin film material on the surface by a sputtering, a chemical vapor deposition (CVD), or the like, pattering a mask material such as a photo resist further formed in a film on the thin film material by photolithography and then carrying out a dry etching process. After that, the mask material is removed and cleaned, and via an inspection process if necessary, the processing moves toward the next process of a film formation of the thin film material. The extraneous matter on the surface as an object to be cleaned includes residues of the mask material, reaction products in the dry etching process, foreign substances transferred in accordance with coming into contact with transport mechanism parts.

As a conventional removal method of the extraneous matter, there is a technique that a two fluids spray is sprayed, for example, this technique is disclosed in the above-mentioned patent literatures 1 to 6.

In addition, as a conventional removal method of the extraneous matter to the metal strip and the metal plate including copper, there are a technique that a lubricating oil on an object to be cleaned is removed by immersing the object in an organic solvent so as to dissolve the lubricating oil in the solvent, and a technique that a fine particle is removed by irradiating an object to be cleaned with an ultrasonic wave in a liquid, for example, as disclosed in the non-patent literature 1.

A problematic point caused when the techniques of the patent literatures 1 to 6 is used for the cleaning of the metal surface to which the mechanical processing is applied are that in accordance with the contact of a gas with a liquid, the liquid is vaporized, an evaporative latent heat is removed, and a temperature is lowered. Generally, the higher a temperature of the liquid is, the more a viscosity of the liquid is lowered, so that the higher the temperature is, the faster a diffusion of contamination substance into a cleaning liquid is. Therefore, in order to enhance the cleaning power, it is effective to heighten the temperature of the cleaning liquid, but in case of using the techniques of the patent literatures 1 to 6, it is difficult to heighten the temperature.

In addition, a problematic point caused when the techniques of the patent literatures 1 to 6 is used for the cleaning of the semiconductor wafer and the glass substrate for liquid crystal that an exhaust facility is needed to be grown in size so as to consume a large amount of gas. For example, the patent literature 4 discloses in paragraph 0029 that a desired gas flow rate is 10 to 100 L/min (normal), and discloses in paragraph 0031 that a desired liquid flow rate is 100 to 200 mL/min. A region covered by one cleaning nozzle is a circle having a diameter of approximately 1 cm at the largest, so that in particular, in case that a large area is cleaned as a case of the glass substrate for liquid crystal, a large number of nozzles are needed to be arranged. For example, since the glass substrate for liquid crystal referred to as the eighth generation has a dimension of 2160×2400 mm, in order to clean the whole surface, it is required that 216 cleaning nozzles are aligned in an array shape over the width of 2160 mm, arrays are arranged so as to sandwich the glass substrate for liquid crystal therebetween in the vertical direction, and the cleaning is carried out while the glass substrate for liquid crystal is moved so that the longitudinal direction of the glass substrate for liquid crystal corresponds to the running direction of the glass substrate. Namely, 432 cleaning nozzles are arranged in one cleaning chamber, in case that each of them discharges a gas of 100 to 200 mL/min, a total flow rate of the gas discharged into the cleaning chamber becomes 43 to 86 $m^3$/min. In order to prevent mist from remaining in the cleaning chamber, a flow rate of the exhaust gas is needed to be not less than a flow rate of the gas discharged into the cleaning chamber, and the flow rate of the exhaust gas per one facility is increased up to 100 to 200 $m^3$/min. In case that a plurality of the above-mentioned exhaust facilities that require a large amount of exhaust are installed in a factory, a burden that the whole of the factory bears for the exhaust facilities is extremely increased.

SUMMARY OF THE INVENTION

Therefore, it is one object of the invention to solve the above-mentioned problem and provide a surface treatment method of a metal member that has a sufficiently high cleaning power to an extraneous matter on a surface of metal, does not contaminate an environment when discharged into the environment such as atmosphere, and does not need a large-scale equipment and a surface treatment device.

In addition, it is another object of the invention to solve the above-mentioned problem and provide a cleaning nozzle that is capable of being heated up to a temperature at which a necessary cleaning power can be obtained, has a sufficiently high cleaning power to an extraneous matter on a surface of solid substance, and does not require a large facility in size for exhaust after the cleaning and is capable of completing the cleaning treatment in a short time and a cleaning method of a surface of a solid substance using the cleaning nozzle and a cleaning device.

(1) According to one embodiment of the invention, a surface treatment method of a metal member comprises:

removing an oily substance on the metal member by using gas-liquid two fluids that are obtained by boiling a heated and pressured water under ordinary pressure.

In the above embodiment (1) of the invention, the following modifications and changes can be made.

(i) The heated and pressured water has a pressure of not more than 0.45 MPa.

(ii) The gas-liquid two fluids have a temperature of not less than 40 degrees C.

(iii) The gas-liquid two fluids are formed of water vapor and water liquid and the water liquid has a droplet diameter of 1 μm to 100 μm.

(2) According to another embodiment of the invention, a surface treatment device of a metal member for removing an oily substance on the metal member comprises:

self-generation two fluids production means for producing gas-liquid two fluids by boiling a heated and pressured water under ordinary pressure; and a surface treatment room carrying out a surface treatment by bringing the self-generation two fluids into contact with the metal member.

In the above embodiment (2) of the invention, the following modifications and changes can be made.

(iv) The self-generation two fluids production means includes a water pressure-heat applying means for applying pressure and heat to water and self-generation two fluids nozzle connected to the water pressure-heat applying means, for spraying the pressured and heated water so as to produce the self-generation two fluids, and when the water heated and pressured by the water pressure-heat applying means is sprayed by the self-generation two fluids nozzle, the self-generation two fluids are generated based on the heated and pressured water sprayed by the nozzle and a water vapor generated by boiling due to pressure drop thereof and is sprayed to a surface of the metal member.

(v) The water pressure-heat applying means includes an electrolysis tank for electrolyzing a liquid including water as a main component and a mixer for supplying one electrolysis ionized water selected from electrolysis ionized waters generated at a positive electrode and a negative electrode due to the electrolysis in the electrolysis tank to the self-generation two fluids nozzle, mixing another electrolysis ionized water and the one electrolysis ionized water after being brought into contact with the metal member so as to carry out the surface treatment of the metal member, and discharging both of the electrolysis ionized waters.

(vi) The self-generation two fluids nozzle includes a spraying part for spraying the pressured and heated water and a rectifying wall nozzle for controlling a spray pattern of the self-generation two fluids sprayed by the spraying part the to be expanded.

(vii) The water heated and pressured by the water pressure-heat applying means has a pressure of not more than 0.45 MPa.

(viii) The self-generation two fluids sprayed to the surface of the metal member have a temperature of not less than 40 degrees C.

(3) According to another embodiment of the invention, a cleaning nozzle for generating gas-liquid two fluids that are obtained by boiling heated and pressured water under ordinary pressure comprises:

an orifice part comprising a flow channel for controlling a flow rate of the heated and pressured water;

an expanded diameter part formed on the downstream side of the orifice part, for expanding a cross-section area of the flow channel of the orifice part and generating the gas-liquid two fluids; and a rectifying part comprising a flow channel formed on the downstream side of the expanded diameter part and simultaneously having a cross-section area larger than the flow channel of the orifice part, for guiding the gas-liquid two fluids to the downstream side.

In the above embodiment (3) of the invention, the following modifications and changes can be made.

(ix) A flow channel formed on the downstream side of the rectifying part and simultaneously having a cross-section area smaller than the flow channel of the orifice part is further comprised, and the cross-section area thereof has a shape of Laval nozzle that expands in the downstream direction gradually.

(x) The orifice part has an inner diameter of not less than 0.2 mm and not more than 0.5 mm.

(xi) The expanded diameter part has an apex angle of not less than 60 degrees and not more than 150 degrees.

(xii) The forward end of the nozzle on the downstream side of the rectifying part has a cross-section area equal to or smaller than the rectifying part.

(4) According to another embodiment of the invention, a cleaning method of a surface of a solid substance comprises:

cleaning the surface of the solid substance by using the gas-liquid two fluids generated by the cleaning nozzle according to the above embodiment (3).

In the above embodiment (4) of the invention, the following modifications and changes can be made.

(xiii) The gas-liquid two fluids have a wind speed of not less than 45 m/s.

(xiv) The heated and pressured water has a temperature of not more than 120 degrees C., and the rectifying part has an inner diameter of not more than 4 mm.

(xv) The heated and pressured water has a temperature of more than 120 degrees C., and the rectifying part has an inner diameter of not more than 6 mm.

(xvi) The solid substance comprises a copper wire or a copper strip.

(5) According to another embodiment of the invention, a cleaning device of a surface of a solid substance for cleaning the surface of the solid substance by using gas-liquid two fluids generated by boiling heated and pressured water under ordinary pressure comprises:

a gas-liquid two fluids generation means for generating the gas-liquid two fluids by boiling the heated and pressured water under ordinary pressure by using a cleaning nozzle comprising an orifice part comprising a flow channel for controlling a flow rate of the heated and pressured water, an expanded diameter part formed on the downstream side of the orifice part, for expanding a cross-section area of the flow channel of the orifice part and generating the gas-liquid two fluids and a rectifying part formed on the downstream side of the expanded diameter part and simultaneously comprising a flow channel having a cross-section area larger than the flow channel of the orifice part, for guiding the gas-liquid two fluids to the downstream side; and a surface cleaning room in which the gas-liquid two fluids are brought contact into the surface of the solid substance so as to carry out the surface cleaning.

In the above embodiment (5) of the invention, the following modifications and changes can be made.

(xvii) The cleaning nozzle comprises a flow channel formed on the downstream side of the rectifying part and simultaneously having a cross-section area smaller than the flow channel of the orifice part is further comprised, and the cross-section area has a shape of Laval nozzle that expands in the downstream direction gradually.

(xviii) The gas-liquid two fluids have a wind speed of not less than 45 m/s.

(xix) The heated and pressured water has a temperature of not more than 120 degrees C., and the rectifying part has an inner diameter of not more than 4 mm.

(xx) The heated and pressured water has a temperature of more than 120 degrees C., and the rectifying part has an inner diameter of not more than 6 mm.

(xxi) The solid substance comprises a copper wire or a copper strip.

Advantages of the Invention

According to one embodiment of the invention, a surface treatment method of a metal member and a surface treatment device that are capable of using self-generation two fluids that can be heated up to a temperature at which a necessary cleaning power can be obtained, completing the cleaning treatment in a short time, and preventing the VOC from being generated, and as a result, preventing a labor working environment and an air pollution from being affected thereby, can be provided.

Furthermore, according to another embodiment of the invention, a cleaning nozzle and a cleaning method of a surface of a solid substance using the cleaning nozzle and a cleaning device that are capable of being heated up to a temperature at which a necessary cleaning power can be obtained, have a sufficiently high cleaning power to an extraneous matter on a surface of solid substance, and do not require a large facility in size for exhaust after the cleaning and are capable of completing the cleaning treatment in a short time and a cleaning method of a surface of a solid substance using the cleaning nozzle and a cleaning device, and further are capable of preventing a volatile organic compound (VOC) from being generated, so that a labor working environment can be improved and an influence on air pollution can be reduced, can be provided.

BRIEF DESCRIPTION OF THE DRAWINGS

The preferred embodiments according to the invention will be explained below referring to the drawings, wherein:

FIGS. 8A and 3B are cross-sectional views schematically showing the self-generation two fluids in case that self-generation two fluids nozzle having a rectifying wall nozzle part according to Example 4 is used;

DETAILED DESCRIPTION OF THE PREFERRED EMBODIMENTS

Figure 1:
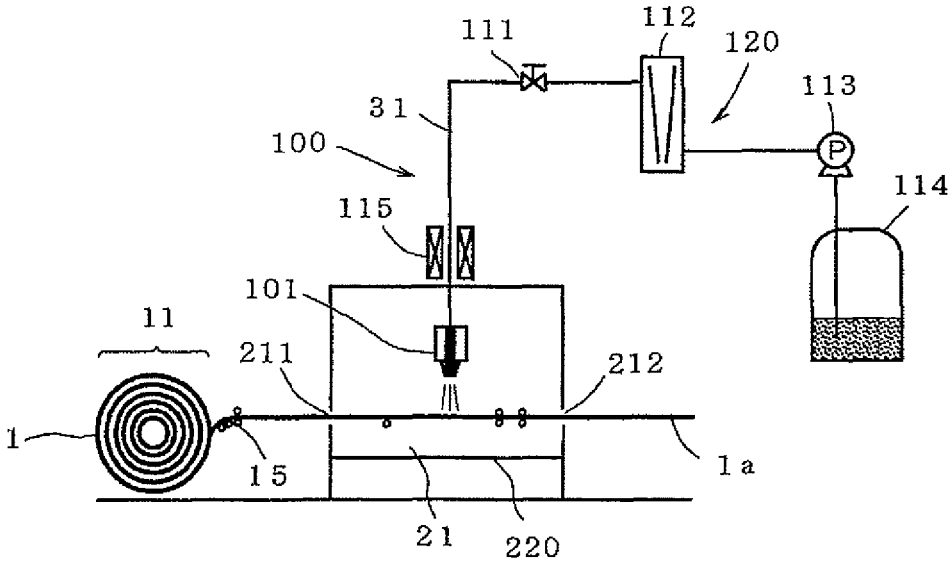
FIG. 1 is an explanatory view schematically showing a surface treatment device used for carrying out a surface treatment method of a copper member according to one embodiment of the invention.

The preferred embodiments according to the invention will be explained below referring to the drawings.

The embodiment of the invention can achieve the removal of an oily liquid such as a rolling process oil adhering to a surface of a metal material by pressuring a liquid including water as a main component to a pressure (P0) of not less than a pressure (P1) of a cleaning zone and simultaneously heating the liquid to a temperature of not less than a boiling point at the pressure (P1) and not more than a boiling point at the pressure (P0), discharging the liquid from a nozzle toward the surface of the metal material as an object to be cleaned, forming a mixture of droplet and water vapor by boiling due to pressure drop at the time, and simultaneously due to volume expansion at the boiling process, accelerating the droplets toward the surface of the object to be cleaned and making the droplets collide with the surface.

First, a surface treatment device by that a surface treatment method of a metal strip (a copper strip) as a metal member according to the embodiment is carried out will be explained referring to FIG. 1.

The metal strip 1*a* wound around the reel 1 is fed from the uncoiler 11, is introduced into the inside of the surface treatment room 21 from an inlet 211 of the cleaning device, and is extracted from an outlet 212 to the outside of the surface treatment room 21.

The metal strip 1*a* introduced into the inside of the surface treatment room 21 is surface-treated by self-generation two fluids production means 100 including self-generation two fluids nozzle 101 and a water pressure-heat applying means 120 to pressure and heat water and supply the water pressured and heated to the self-generation two fluids nozzle 101, so that the oily liquid such as the rolling process oil adhering to the surface of the metal material can be removed.

Hereinafter, the self-generation two fluids production means 100 will be explained.

The self-generation two fluids nozzle 101 is arranged in the surface treatment room 21. The water pressure-heat applying means 120 has a structure that a water tank 114 is connected to a piping 31 connected to the self-generation two fluids nozzle 101 via a heater 115, a flow control valve 111, a flow meter 112 and a pump 113. Here, the pump 113 and the flow control valve 111 is set to an appropriate value, so that the water is pressured to a pressure not less than the pressure (P1) of the cleaning zone, and delivered. The pressure of the water at this time is defined as P0. Also, the heater 115 is appropriately functioned, so that the water is heated to a temperature not less than the boiling point at the pressure (P1). The water pressured and heated as described above is discharged from the self-generation two fluids nozzle 101, simultaneously is boiled due to pressure drop, and generates gas-liquid two fluids including water and water vapor spontaneously. Namely, the gas-liquid two fluids can be generated by appropriately setting the temperature and the pressure without introducing a gas separately from a liquid as a usual two fluids.

Hereinafter, the gas-liquid two fluids are referred to as the self-generation two fluids.

The self-generation two fluids sprayed from the self-generation two fluids nozzle 101 are sprayed to the metal strip 1*a*, so that the extraneous matter on the surface of the metal strip 1*a* is removed, is stored in a receiving tray 220, and is discharged from the receiving tray 220 appropriately.

The self-generation two fluids include almost only water, so that needless to say, an environmental load is small even if it is discharged into atmosphere.

Here, the patent literature 11 discloses a method of using a cleaning liquid pressured to not less than 5 MPa, but as a result of investigation of the inventors, it has become clear that in case of using the self-generation two fluids, a cleaning power not less than a power disclosed in the patent literature 11 can be obtained, even if the pressure is 0.45 MPa at the highest.

The self-generation two fluids are generated by utilizing a boiling of liquid, so that the temperature just after the generation is equal to the boiling point. On the other hand, for example, in case that under atmospheric pressure, a liquid and a gas that have a temperature of almost 100 degrees C. are fed to the self-generation two fluids nozzle so as to generate gas-liquid two fluids, the temperature of the gas-liquid two fluids generated is lowered to almost 70 degrees C. Also, for example, in case that water vapor and water that have a temperature of almost 100 degrees C. are fed to the self-generation two fluids nozzle so as to generate gas-liquid two fluids, gas-liquid two fluids of almost 100 degrees C. are generated, but a different problem is caused, that two feeding system are required, so that the equipment is complicated.

The patent literatures 7, 8 and 10 disclose cleaning techniques of using water and water vapor, but any of them uses water and water vapor introduced into a nozzle through a separate piping, so that it is required to control parameters of each of the water and water vapor such as a temperature, a pressure, a flow volume independently.

To the contrary, the present invention uses the self-generation two fluids, so that parameters to be controlled can be reduced, and as a result, an equipment cost and a load on process control can be reduced.

Also, the self-generation two fluids are capable of accelerating a speed of the droplet by utilizing a volume expansion due to the boiling.

In the usual two fluids, for example, the patent literature 4 discloses that a desired gas flow volume is 10 to 100 L/min (normal) and similarly, the patent literature 4 discloses that a desired liquid flow volume is 100 to 200 mL/min. In case that the gas is generated from water, the liquid flow volume becomes 8.0 to 80 mL/min. Consequently, 18 to 280 mL of water are heated and pressured, and then discharged from the nozzle, so that the gas-liquid two fluids having desired flow volumes described in the patent literature 4 can be generated by using a more simple equipment having only one feeding system, without using the method disclosed in the patent literature 4. The self-generation two fluids generated as described above are brought into contact with the surface of the metal strip, so that a cleaning-treatment of the surface of the metal strip can be carried out.

The patent literatures 1 to 4 disclose a method of generating two fluids by using water and gas introduced into a nozzle through a separate piping, but the nozzle has a complicated structure so as to introduce two fluids and it is required to control parameters of each of the water and gas such as a temperature, a pressure, a flow volume independently. In case of generating the self-generation two fluids, a one fluid nozzle with a simple structure can be used.

Hereinafter, a mechanism that contamination is removed will be explained as a result of investigation of the inventors.

Namely, a lubricating oil for processing or a metal powder as the extraneous matter receives a kinetic energy from droplets made collide therewith, and in case that the largeness thereof is not less than an adhesion energy to the metal surface, it is removed from the metal surface. In case that an oily contamination insoluble in water such as the lubricating oil for processing is brought into contact with gas-liquid two fluids mainly formed of water, the oily contamination can not be dissolved in the droplets constituting the gas-liquid two fluids, so that it is collected in interfaces between the droplets and the gas. However, the metal surface is covered with a liquid film of a certain thickness, so that the oily contamination that could not be collected in the interfaces of the droplets between the gas adheres to the metal surface again with a certain probability.

Consequently, the larger the area of the gas-liquid interfaces that the droplets constituting the gas-liquid two fluids have is, the higher the cleaning power is, therefore, in case that a liquid quantity forming the gas-liquid two fluids is equal to each other, the smaller the droplet diameter is, the higher the cleaning power is. In accordance with investigation of the inventors, a range of the appropriate droplet diameter is not less than 1 μm and not more than 100 μm.

In addition, the higher the temperature is, the more the oily substance is decreased in viscosity, so that the droplets can smoothly move from the metal surface to the gas-liquid interfaces of the droplets. As a result of investigation of the inventors, it has been confirmed that when the temperature of the gas-liquid two fluids becomes not less than 40 degrees C., a removal efficiency in the cleaning by the gas-liquid two fluids is enhanced, when the temperature becomes not less than 65 degrees C., the efficiency is further enhanced, and when the temperature becomes not less than 80 degrees C., the efficiency is furthermore enhanced. When the removal efficiency is enhanced, a removal treatment can be carried out in a short time. As described above, the metal strip or the metal wire is treated while moving, so that if the treatment time is short, the length of the treatment zone can be shortened.

The patent literature 5 discloses a method of cleaning a tape-like member moving in a linear speed of 3 m/min, but does not disclose that the oily substance can be removed.

In addition, the patent literature 9 discloses that a pressured hot water is directly sprayed, and by the boiling due to pressure drop when sprayed, a water vapor body and a water mist body are formed, but as the effect, it only discloses that a resist used for photolithography can be removed, but it does not disclose that the oily substance can be removed. Namely, it has been clarified for the first time by investigation of the inventors that the oily substance can be removed by using the self-generation two fluids.

In case that the self-generation two fluids are generated, a usually-used nozzle for discharging one fluid (hereinafter referred to as a one fluid nozzle) can be used, but a nozzle having a rectifying wall nozzle part is used, so that the removal performance in cleaning can be enhanced. Namely, the spray discharged from the one fluid nozzle is diffused at a certain angle. At this time, it comes into contact with ambient air and exchanges heat with the air, so that the temperature is lowered. In order to use a spray having a higher temperature, it is preferred to use the nozzle having the rectifying wall and block contact of the spray with the ambient air. The rectifying wall can be formed so as to be integrally with or separately from the nozzle.

Even the self-generation two fluids generated by heating and pressuring only water provide a sufficient effect in removal of the oily contamination, but in order to heighten the removal speed, it is preferred to use an electrolysis ionized water. Namely, it can be adopted a procedure that the electrolysis ionized waters (hereinafter referred to as a positive electrode water and a negative electrode water respectively) are generated at a location adjacent to each of a positive electrode and a negative electrode by electrolysis of water, one of the positive electrode water and the negative electrode water is heated and pressured and introduced into the self-generation two fluids nozzle, and after the cleaning treatment, it is mixed with another of the positive electrode water and the negative electrode water, and the mixture is discharged.

The patent literature 6 discloses a method of removing fingerprints by a gas-liquid two fluids using an electrolysis ionized water, but does not disclose removal of the oily substance such as a lubricating oil attached due to a processing of a metal material. Generally, the fingerprints is entirely different in properties from the lubricating oil, even if both are commonly categorized into an organic substance, and the lubricating oil after a mechanical processing has an attached amount larger than the fingerprints. It has been clarified for the first time by investigation of the inventors that the oily substance can be cleaned and removed by the self-generation two fluids using the electrolysis ionized water.

Next, another embodiment of the invention will be explained referring to FIG. 5.

Figure 5:
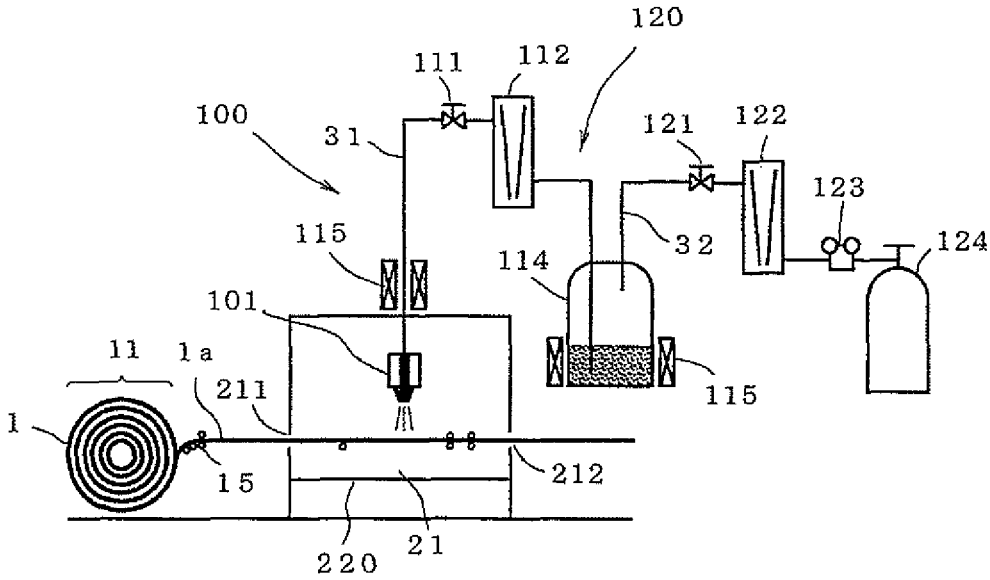
FIG. 5 is an explanatory view schematically showing a surface treatment device used for carrying out a surface treatment method of a copper member according to another embodiment of the invention.

The surface treatment device shown in FIG. 5 is basically equal to the surface treatment device shown in FIG. 1, but different in that a liquid is fed under pressure by a gas pressurizing instead of using a pump as the water pressure-heat applying means 120.

First, the self-generation two fluids nozzle 101 is arranged in the surface treatment room 21.

The water pressure-heat applying means 120 has a structure that a water tank 114 is connected to a piping 31 connected to the self-generation two fluids nozzle 101 via a heater 115, a flow control valve 111, and a flow meter 112, and simultaneously, a gas bomb 124 is connected to the water tank 114 via a piping 32, and a gas pressure controller 123, a gas flow meter 122 and a gas flow control valve 121 are connected to the piping 32 from a side of the gas bomb 124 to a side of the water tank 114 in this order.

In addition, heaters 115 are installed in both locations along the way of the piping 32 and at the water tank 114.

In the embodiment shown in FIG. 5, a gas from the gas bomb 124 is adjusted by the gas pressure controller 123, the gas flow meter 122 and the gas flow control valve 121 and is fed into the water tank 114, so that the self-generation two fluids can be generated from the self-generation two fluids nozzle 101 and can be sprayed to the metal strip (copper strip) 1*a*.

Figure 9:
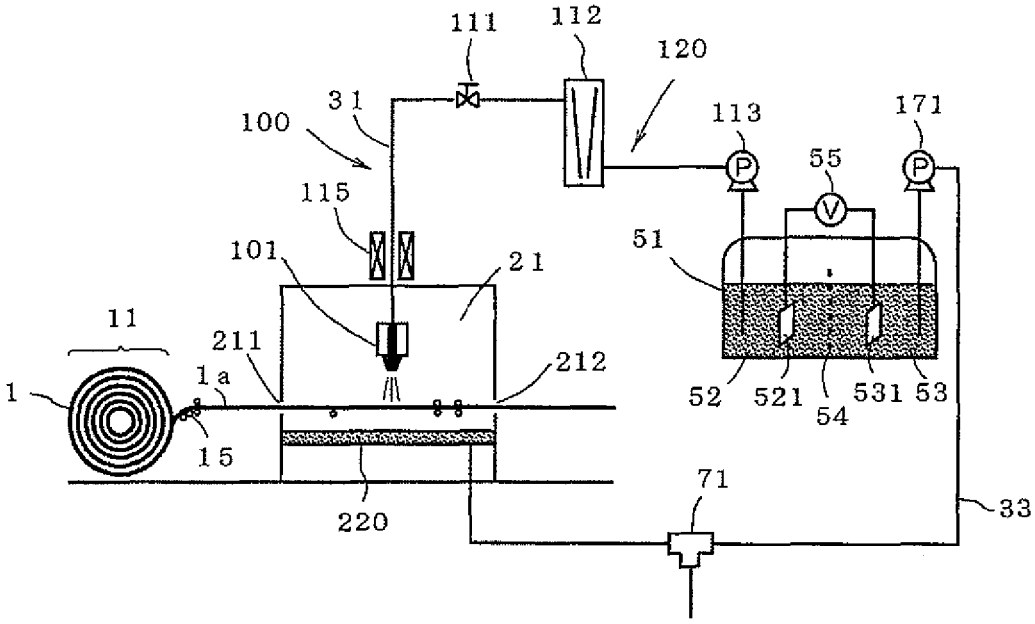
FIG. 9 is an explanatory view schematically showing a surface treatment device used for carrying out a surface treatment method of a copper member according to further another embodiment of the invention.

FIG. 9 shows further another embodiment of the invention, and the embodiment is constructed such that electrolysis ionized water located at a side of the positive electrode or a side of the negative electrode is fed from the water pressure-heat applying means 120 connected to the self-generation two fluids nozzle 101, and the self-generation two fluids generated by using the electrolysis ionized water are sprayed.

In FIG. 9, the metal strip 1*a* wound around the reel 1 is fed from an uncoiler 11, and the metal strip 1*a* is introduced into the inside of the surface treatment room 21 from the inlet 211 of the surface treatment room 21 and is discharged into the outside of the surface treatment room 21 from the outlet 212.

The self-generation two fluids nozzle 101 is arranged in the surface treatment room 21.

The water pressure-heat applying means 120 is constructed such that a water electrolysis tank 51 is connected to a piping 31 connected to the nozzle 101 via a flow control valve 111, a flow meter 112 and a pump 113.

The water electrolysis tank 51 is separated to two rooms of an A electrode room 52 in which an electrode A 521 is disposed and a B electrode room 53 in which an electrode B 531 is disposed by a dividing wall 54 that does not inhibit ions from moving. A direct current power source 55 is connected to the electrode A 521 and the electrode B 531, and an electrolysis is carried out while setting one of the A electrode room 52 and the B electrode room 53 to a positive electrode and another of them to a negative electrode, so that the electrolysis ionized water can be introduced into the self-generation two fluids nozzle 101.

By setting the pump 113 and the flow control valve 111 to an appropriate value, the electrolysis ionized water is introduced into the self-generation two fluids nozzle 101 and the self-generation two fluids discharged from the self-generation two fluids nozzle 101 are brought into contact with the surface of the metal strip 1*a*, so that the cleaning treatment of the surface of the metal strip 1*a* can be carried out. The self-generation two fluids discharged into the surface of the metal strip 1*a* are discharged from a receiving tray 220 as a cleaning waste liquid into the outside of the surface treatment room 21.

The electrolysis ionized water generated in the B electrode room 53 of the water electrolysis tank 51 is transported by a piping 33 via a pump 171 and is mixed with the cleaning waste liquid of the surface treatment room 21 by a mixer 71 so as to be neutralized, and the mixture is discarded as a final waste liquid.

EXAMPLES

Example 1

In FIG. 1, a copper strip after completion of a rolling process was used as the metal strip and a tank in which pure water is filled was used as the water tank, and removal of a rolling process lubricating oil on the surface of the copper strip was carried out.

The copper strip fed from the uncoiler 11 was introduced into the surface treatment room 21 from the inlet 211, after a cleaning treatment was applied thereto for a predetermined time, and was extracted from the outlet 212 to the outside of the surface treatment room 21. Water was fed from the water tank 114 while pressured by the pump 113 and reached the nozzle 101 via the flow meter 112 and the flow control valve 111. Heating was carried out by the heater 115 installed along the way of the piping 31.

As the self-generation two fluids nozzle 101 for discharging the self-generation two fluids, a nozzle manufactured by Spraying Systems Co., model number: HB-1/4-VV-SS-80-0050 was used. The spray angle was 80 degrees and the orifice diameter was 50 μm.

Figure 12:
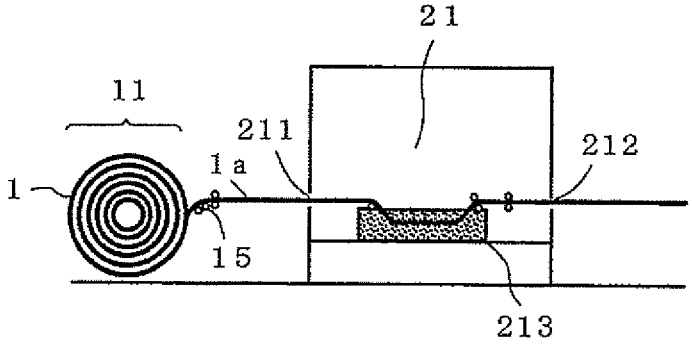
FIG. 12 is an explanatory view schematically showing a conventional surface treatment device of a metal material in detail.
Figure 13:
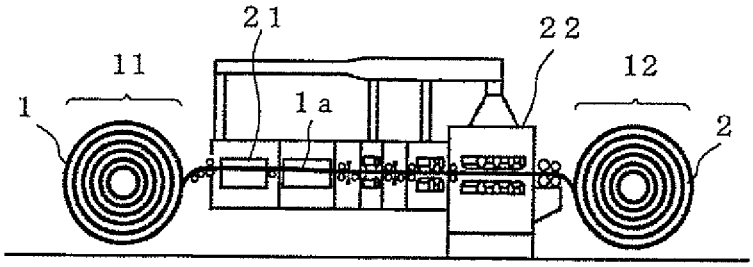
FIG. 13 is an explanatory view schematically showing a conventional surface treatment device of a metal material.

As Comparative Example 1, a copper strip was immersed into each of an organic solvent, a pure water, and a micro-bubble water by using an equipment shown in FIG. 12 and removal performance of roll processing lubricating oil on the surface of the copper strip was evaluated. Further, as the organic solvent described in Comparative Example 1, decane warmed up to 35 degrees C. was used, and as the micro-bubble water, micro-bubble water generated by the method described in the patent literature 12 was used.

In Example 1 and Comparative Example 1, a length of the cleaning zone was set to 2 m. In Example 1, the nozzle was arranged so that the spray was formed without being interrupted over the cleaning zone, and in Comparative Example 1, as the length of the cleaning zone, a length of a cleaning tank was used. A cleaning time was adjusted by changing a linear speed of the copper strip.

Figure 2:
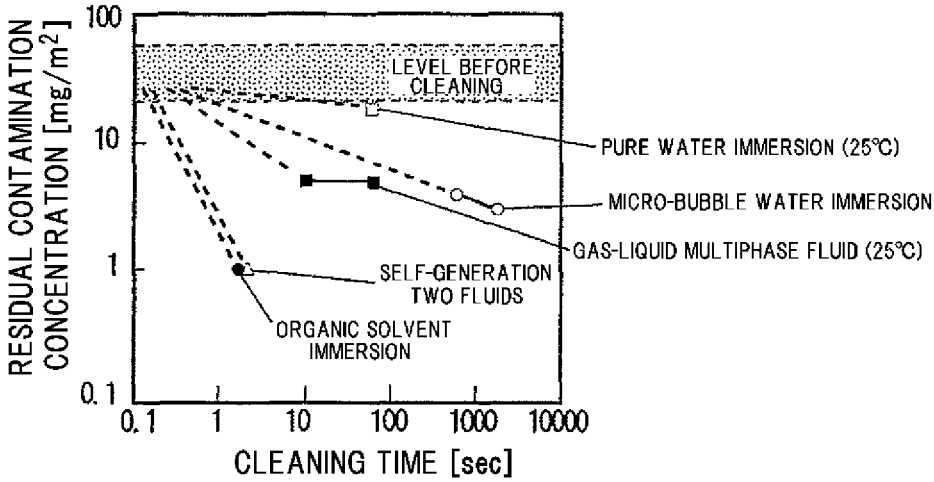
FIG. 2 is a graph showing a result of cleaning of a copper strip in Example 1 using the device shown in FIG. 1.

FIG. 2 shows an evaluation result of residual contamination concentration after cleaning.

It was confirmed that in case of using the self-generation two fluids, the residual contamination concentration can be reduced in a shorter time in comparison with the pure water immersion and the micro-bubble water immersion.

Example 2

A cleaning was carried out in a shorter time by using the same spray nozzle as Example 1. The cleaning was carried out on the condition that a spray pattern located at a distance of 20 mm from the nozzle was a rectangular shape of 10×30 mm, and a width direction of the copper strip was corresponded to a long side of the spray pattern. The linear speed of the copper strip was set to 60 m/min. At this time, a time when the copper strip passes under the one spray is 0.01 second. A desired cleaning time was obtained by 1 to 30 nozzle(s) was (were) arranged in the surface treatment room 21, the linear speed was set to a constant value and the number of the nozzle was changed.

Figure 3:
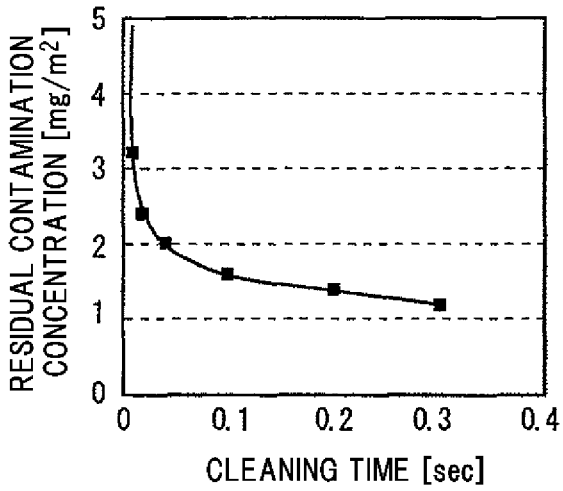
FIG. 3 is a graph showing a result of cleaning of a copper strip in Example 2 using the device shown in FIG. 1.

FIG. 3 shows a result from that the cleaning was carried out by using a copper strip having an oil concentration of almost 100 mg/m$^2$, and the residual contamination concentration after cleaning was measured. It was confirmed that the copper strip of Example 2 became clean even if in a shorter time than Example 1.

Figure 4:
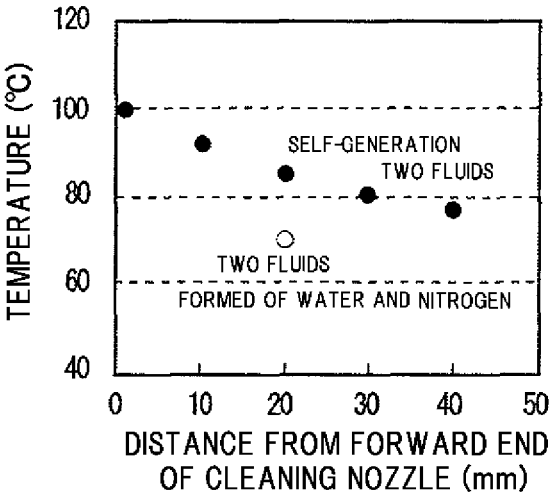
FIG. 4 is a graph showing a relationship between a distance from a forward end of self-generation two fluids nozzle and a temperature of the self-generation two fluids.

Here, FIG. 4 shows a temperature distribution from a forward end of the nozzle.

As Comparative Example 1, a result of a two fluids spray generated by using heated water (100 degrees C.) and nitrogen gas, and a two fluids nozzle manufactured by Spraying Systems Co., model number: B-1/4JBC-SS was shown.

FIG. 4 shows that the temperature of the self-generation two fluids was almost 100 degrees C. at a location just below the nozzle and also was 78 degrees C. at a distance of 40 mm from the nozzle. On the other hand, the temperature of the conventional two fluids spray was 70 degrees C. at a location of 20 mm from the nozzle at which the cleaning is actually carried out. It can be ensured that the self-generation two fluids have a temperature equal or higher than the conventional two fluids spray even if it is located at a distance of 40 mm from the nozzle. Namely, the self-generation two fluids are optimum as a method for generating two fluids having a temperature of not less than 80 degrees C. that could not be realized by the conventional two fluids spray.

Example 3

A generation of the self-generation two fluids and a cleaning treatment were carried out by using the surface treatment device explained in FIG. 5.

Namely, the surface treatment device shown in FIG. 5 is similar to the surface treatment device shown in FIG. 1, but a liquid is fed under pressure by a gas pressurizing instead of using a pump. In addition, heaters are installed in both locations along the way of the piping and at the water tank.

Here, the self-generation two fluids were generated by two systems respectively.

In a system A as one system, a temperature was constantly retained to 105 degrees C., and a pressure was adjusted by a pressure of the gas used for the feeding under pressure. Since a vapor pressure of water at the temperature is 0.15 MPa, in case that a pressure equal or higher than the pressure was needed, pressurizing due to introducing a gas was carried out.

In a system B as another system, heating was carried out so that the vapor pressure of water became a predetermined pressure, without introducing the gas.

Figure 6:
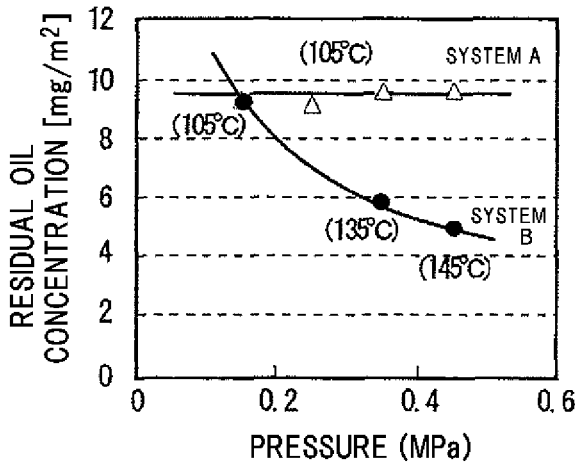
FIG. 6 is a graph showing an effect of a pressure and a temperature of the self-generation two fluids to a cleaning power.

The self-generation two fluids were produced by using the pressured and heated water generated as described above and the cleaning was carried out. FIG. 6 shows an analysis result of the residual contamination concentration after cleaning.

In case of the system A, a change in the residual contamination concentration was not shown even if the pressure of fed liquid was heightened by introducing the gas, on the other hand, in case of the system B, the residual contamination concentration was reduced in accordance with increase in the pressure and temperature. Namely, it was shown that the higher the temperature of water supplied is, the more the desirability is.

Further, in Example 3, the evaluation was carried out by using a spray nozzle different from that used in the experiment shown in FIG. 3 of Example 2, so that the results were different despite the same treatment in temperature and pressure. For example, the treatment of 0.01 second in FIG. 3 is different in the residual contamination concentration from the treatment of 0.15 MPa in FIG. 6 despite the same condition of temperature, pressure and treating time.

Example 4

Various nozzles were installed in the equipment shown in FIG. 5, and a cleaning of a copper strip was carried out similarly to Example 3. The temperature was set to 145 degrees C. and a feeding under pressure was carried out by using a pressure of water vapor without introducing a gas from the outside.

Figure 7:
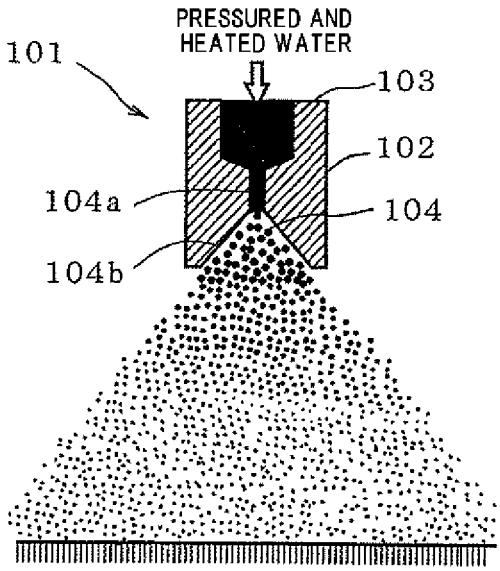
FIG. 7 is a cross-sectional view schematically showing the self-generation two fluids in case that a usual one fluid nozzle is used as the self-generation two fluids nozzle used for the embodiment of the invention.
Figure 8A:
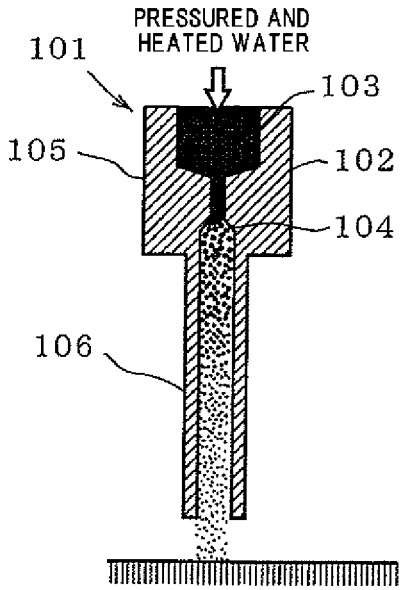
Figure 8B:
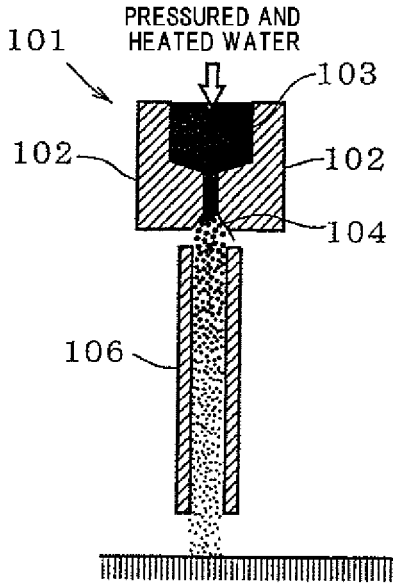

The self-generation two fluids nozzles 101 are shown in FIGS. 7, 8A and 8B.

Figure 11:
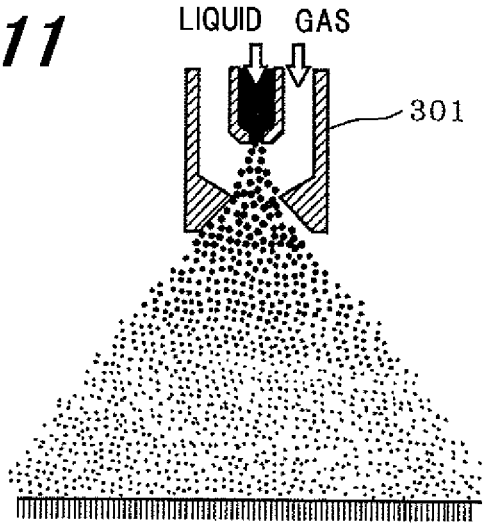
FIG. 11 is a cross-sectional view schematically showing a generation of the self-generation two fluids in case that a general nozzle is used as the self-generation two fluids nozzle in the embodiment of the invention.

In addition, for comparison, the conventional two fluids nozzle 301 is shown in FIG. 11

The self-generation two fluids nozzle 101 shown in FIG. 7 uses a usual one fluid nozzle, and a nozzle body 102 has a storage room 103 of the pressured and heated water and a nozzle hole 104 formed below the storage room 103, and the nozzle hole 104 is provided with an orifice part 104*a* and an expanded diameter part 104*b* capable of forming a spray pattern of a fan-like shape or a conical shape in order to expand a spray range from the orifice part 104*a*, and the spray pattern of the expanded diameter part 104*b* of the self-generation two fluids nozzle 101 shown in FIG. 7 used in Example 3 is also the fan-like shape of almost 80 degrees. Due to this, the larger the distance from the forward end of the self-generation two fluids nozzle 101 is, the more the spray area is increased. Since the volumetric flow of the two fluids fed is almost constant, the larger the distance from the forward end of the self-generation two fluids nozzle 101 is, the more the linear speed is lowered. In addition, as a result, the two fluids exchange heat with ambient air so that the temperature is lowered.

On the other hand, as shown in FIGS. 8A and 8B, the self-generation two fluids nozzle 101 particularly suitable for the invention includes a spray part 105 having a storage room 103 and a nozzle hole 104, and a rectifying wall nozzle 106 for preventing the spray pattern of the two fluids sprayed from the nozzle hole 104 of the spray part 105 from expanding, and FIG. 5A shows a case that the spray part 105 and rectifying wall nozzle 106 are integrated with each other so as to form the self-generation two fluids nozzle 101 and FIG. 8B shows a case that the spray part 105 and rectifying wall nozzle 106 are separated from each other so as to form the nozzle 101. As shown in the self-generation two fluids nozzle 101 of FIG. 8B, a space is formed between the spray part 105 and rectifying wall nozzle 106, so that for example, a size of the spray pattern can be flexibly changed corresponding to a size of the work.

In the self-generation two fluids nozzles 101 shown in FIGS. 8A and 8B, since the rectifying wall nozzle 106 is installed so as to prevent a spray area from being increased with distance from the forward end of the nozzle hole 104 of the spray part 105, it is expected that decrease in the linear speed and the temperature can be prevented due to an effect of the rectifying wall.

Table 1 shows a result of an evaluation after cleaning.

TABLE 1

| Item | Kind of nozzle | Amount of residual oil ($mg/m^2$)* |
|---|---|---|
| Example 3 | Usual one fluid nozzle (FIG. 7) | 5.0 (Acceptable) |
| Example 4 | One fluid nozzle with rectifying wall (FIG. 8A) | 3.0 (Acceptable) |

*cleaning time; 0.01 second, target value; equal or less than 10 $mg/m^2$

In case of using the one fluid nozzle having the rectifying wall nozzle part, the amount of residual oil is smaller than that in case of using the usual one fluid nozzle. Namely, the effect of the rectifying wall nozzle part was confirmed. Further, as a shape of the rectifying wail nozzle part, a cylindrical shape is used in FIG. 8, but not limited to this, an almost quadrangular prism-like shape can be also used.

In addition, the number of the self-generation two fluids nozzle 101 used in the Example is one, any nozzle has a length of cleaning region of 10 mm in a running direction of the copper strip, and the running speed of the copper strip is 60 m/min. Consequently, the cleaning time becomes 0.01 second. In addition, the self-generation two fluids nozzle 101 used in the Example has the same ratio of a discharging flow volume to a supplied pressure as the self-generation two fluids nozzle used in Example 3.

Example 5

By using the device shown in FIG. 9, a positive electrode water and a negative electrode water are generated due to water electrolysis, gas-liquid two fluids (self-generation two fluids) are generated by using the electrode waters, and a cleaning treatment of a surface of a copper strip is carried out similarly to Example 1.

In FIG. 9, the metal strip 1*a* wound around the reel 1 is fed from an uncoiler 11, is introduced into the inside of the surface treatment room 21 from an inlet 211 of the cleaning device, and is discharged from an outlet 212 to the outside of the surface treatment room 21. Self-generation two fluids nozzle 101 for generating self-generation two fluids is disposed in the surface treatment room 21, and a piping 31 connected to the nozzle 101 is connected to a water electrolysis tank 51 via a flow meter 112 and a pump 113. The water electrolysis tank 51 is separated to two rooms of an A electrode room 52 in which an electrode A 521 is disposed and a B electrode room 53 in which an electrode B 531 is disposed by a dividing wall 54 that does not inhibit ions from moving. An electrolysis is carried out while setting one of the A electrode room 52 and the B electrode room 53 to a positive electrode and another of them to a negative electrode, so that the electrolysis ionized water can be introduced into the self-generation two fluids nozzle 101.

By setting the pump 113 and the flow control valve 111 to an appropriate value, the electrolysis ionized water is introduced into the self-generation two fluids nozzle 101 for generating gas-liquid two fluids and the gas-liquid multiphase fluid discharged from the self-generation two fluids nozzle 101 is brought into contact with the surface of the metal strip 1*a*, so that the cleaning treatment of the surface of the metal strip 1*a* can be carried out. The gas-liquid multiphase fluid discharged into the surface of the metal strip 1*a* is discharged as a cleaning waste liquid into the outside of the surface treatment room 21.

The electrolysis ionized water generated in the B electrode room 53 of the water electrolysis tank 51 is transported by a piping 33 via a pump 171 and is mixed with a cleaning waste liquid at the inside or outside of the surface treatment room 21 by a mixer 71, and is discarded as a final waste liquid.

By using the above-mentioned equipment, 0.1 mol/L of potassium sulfate aqueous solution was filled into the water electrolysis tank 51 and an electrolysis of water was carried out while using the electrode A 521 as the negative electrode, and a cleaning treatment of the surface of the copper strip was carried out similarly to Example 2.

For comparison, by using the equipment shown in FIG. 1 and also using pure water, a cleaning treatment of the surface of the copper strip was carried out similarly to Example 2.

Figure 10:
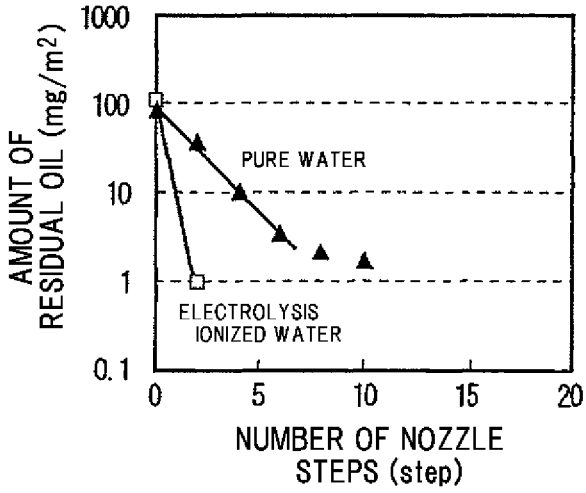
FIG. 10 is a graph showing an effect of cleaning of a copper strip according to Example 5 using a device shown in FIG. 9.

FIG. 10 shows the result. It is clear that in case of using the electrolysis ionized water, the residual oil concentration can be reduced in a shorter time in comparison with a case of using pure water.

In addition, the final waste liquid has a hydrogen-ion exponent of 7.2, and the level is such that it can be discarded to a sewerage or can be discharged into rivers after an oil-water separating treatment.

Further, in the Example, 0.1 mol/L, of potassium sulfate aqueous solution was filled into the water electrolysis tank, but not limited to this, an aqueous solution having an appropriate concentration and electrolyte can be also used. In addition, in the Example, the electrode A was used as the negative electrode, but not limited to this, the electrode A can be also used as the positive electrode in accordance with a kind of the contamination substance to be removed by cleaning. For example, in case that the contamination substance to be removed includes a rolling lubricating oil containing ester as a main component, an alkaline aqueous solution that is generated in the A electrode room by using the electrode A as the negative electrode is used, so that removal can be efficiently carried out due to hydrolysis of the ester. At this time, an acidic solution is generated in the B electrode room. In addition, in case that the contamination substance to be removed includes a salt referred to as a metal soap composed of a metal ion and a carboxylic acid as a main component, an acidic solution that is generated in the A electrode room by using the electrode A as the positive electrode is used, so that removal can be efficiently carried out due to dissolution of the metal soap. At this time, an alkaline aqueous solution is generated in the B electrode room. In every case, the electrolysis ionized water generated in the B electrode room is mixed with the cleaning waste liquid, so that the cleaning waste liquid is neutralized and additional neutralization treatment becomes unnecessary.

Furthermore, the preferred embodiments according to the invention will be explained below referring to the drawings.

A problem that a large facility in size for exhaust after the cleaning is not required, of the above-mentioned problems can be achieved by using the self-generation two fluids described below. A liquid including water as a main component is pressured to a pressure (P0) of not less than a pressure (P1) of a cleaning zone and simultaneously the liquid is heated to a temperature (T0) of not less than a boiling point at the pressure (P1) and not more than a boiling point at the pressure (P0), and the liquid is discharged from a nozzle toward the surface of an object to be cleaned, so that a mixture of droplet and water vapor, namely gas-liquid two fluids is (are) spontaneously generated by the boiling due to pressure drop at the time. The inventors have named this self-generation two fluids. The self-generation two fluids is cooled after a certain time and the component of water vapor is condensed so as to reduce the volume, so that the burden on the exhaust can be reduced.

In addition, a problem that a high cleaning power is realized, of the above-mentioned problems can be achieved by using a cleaning nozzle capable of accelerating the speed of the droplets toward the surface of the object to be cleaned due to the volume expansion in a boiling process of the self-generation two fluids and the droplets are made collide with the surface of the object to be cleaned. The patent literatures 1 to 4 disclose a structure of a nozzle for accelerating the speed of the droplets for two fluids cleaning, but although the self-generation two fluids have been tried to be generated, the droplets have merely dripped from the pipe wall and the water vapor does nothing but pass through near the center of the pipe line, and two fluids in which the droplets are appropriately dispersed could not be obtained. The inventors have earnestly studied, and as a result, the problem has been solved by a structure of the nozzle according to the invention. Namely, the above-mentioned problem can be solved by using a nozzle including an orifice part, an expanded diameter part and a rectifying part.

Previously, a brief outline of the invention was described, but hereinafter, each of the above-mentioned items will be explained in detail.

Figure 14:
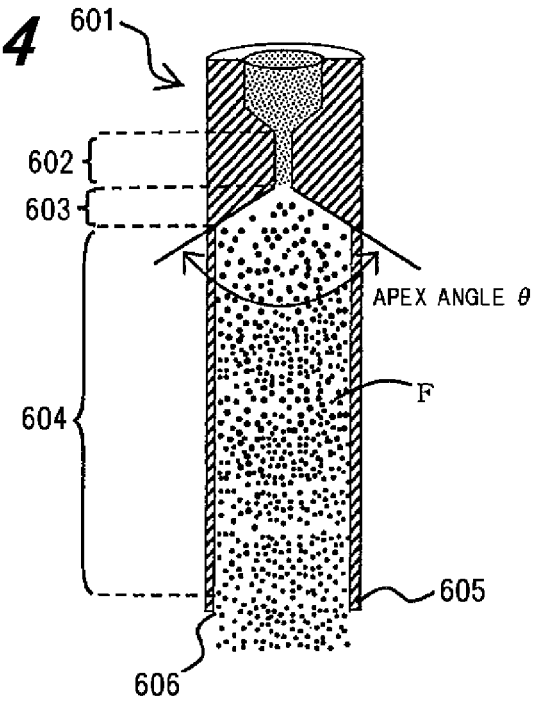
FIG. 14 is a cross-sectional view schematically showing a cleaning nozzle according to one embodiment of the invention.

First, a cleaning nozzle according to one embodiment is explained referring to FIG. 14.

As shown in FIG. 14, the cleaning nozzle 601 according to the embodiment includes an orifice part 602 comprising a flow channel for controlling a flow rate of the heated and pressured water, an expanded diameter part 603 formed on the downstream side of the orifice part 602, for expanding a cross-section area of the flow channel of the orifice part 602 from the upstream side to the downstream side and generating self-generation two fluids F and a rectifying part 604 including a flow channel formed on the downstream side of the expanded diameter part 603 and simultaneously having a cross-section area larger than the flow channel of the orifice part 602, having a tubular shape of a predetermined length, for guiding the self-generation two fluids F to the downstream side, and a forward end part of nozzle 605 for determining a spray pattern after being discharged from the cleaning nozzle 601. In the embodiment, the forward end part of nozzle 605 has the same cross-section shape of the flow channel as the rectifying part 604, but the shape of the forward end part of nozzle 605 can be freely chosen so as to obtain a desired spray pattern.

Figure 15:
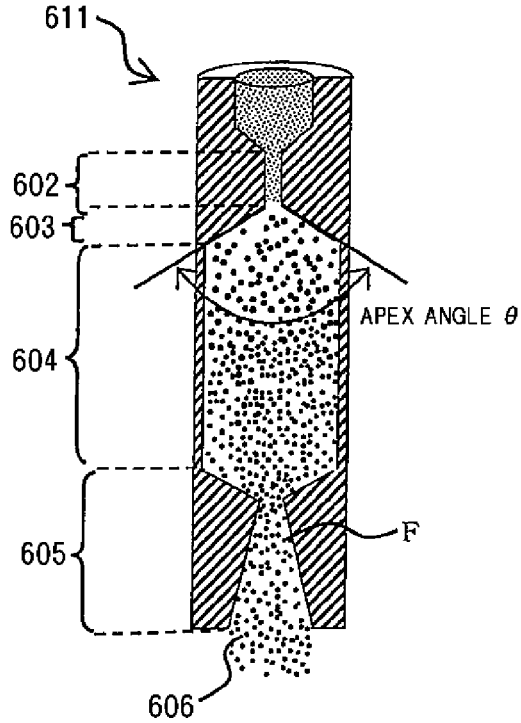
FIG. 15 is a cross-sectional view schematically showing a cleaning nozzle according to another embodiment of the invention.

One example of the shape of the forward end part of nozzle 605 is explained as a cleaning nozzle according to another embodiment referring to FIG. 15.

As shown in FIG. 15, the cleaning nozzle 611 according to another embodiment is constructed such that the forward end part of nozzle 605 has a so-called Laval nozzle shape in which after the cross-section area of the flow channel is once reduced from the rectifying part 604 to the forward end part of nozzle 605, it is gradually enlarged toward the flowing direction of the fluids, different from the cleaning nozzle 601 according to the embodiment.

Hereinafter, generation of the self-generation two fluids by using the cleaning nozzles 601, 611 will be explained.

When a heated and pressured water pressured to a pressure (P0) of not less than a pressure (P1) (a static pressure) in a usage environment of the cleaning nozzles 601, 611 and heated to a temperature (T0) of not less than a boiling point (T1) at the pressure (P1) passes through the orifice part 602, the pressure is lowered as it comes near the expanded diameter part 603. Namely, a pressure gradient exists in a direction of the flow channel. On the other hand, a temperature is lowered due to the fact that the cleaning nozzle 601 deprives the heated and pressured water of heat for some time from the start of flowing, but becomes almost equal to the feeding temperature (T0) after a certain period of time. As a result, the heated and pressured water boils at the time when the pressure becomes lower than the vapor pressure at the temperature (T0), so that the self-generation two fluids F including water and water vapor is generated.

Generally, a liquid is expanded in volume thereof by being boiled, and in case of water, the volume is expanded up to approximately 1700 times at 100 degrees C. For example, when water having a flow rate of 18 to 280 mL/min is heated and pressured and is discharged from the cleaning nozzles 601, 611, water having a flow rate of 8 to 80 mL/min and water vapor having a flow rate of 10 to 100 L/min can be obtained.

The patent literature 4 discloses in paragraph 0029 that a desired gas flow rate is 10 to 100 L/min (normal), and discloses in paragraph 0031 that a desired liquid flow rate is 100 to 200 mL/min. However, in a method of generating two fluids by using water and gas that are introduced into the cleaning nozzle through a separate piping, a cleaning nozzle is needed to have a complex structure due to the introduction of the two fluids, in addition, parameters of each of the fluids such as a temperature, a pressure are needed to be controlled independently.

On the other hand, control parameters for generating the self-generation two fluids are only the temperature and the pressure of the pressured and heated water so as to be simple.

Namely, by using the self-generation two fluids F, a gas-liquid two fluids having a desired flow volume described in the patent literature 4 can be generated by using simpler equipment having only one feeding system, without using the method disclosed in the patent literature 4.

When the self-generation two fluids F that come out of the orifice part 602 reach the rectifying part 604 located at the further downstream side than the expanded diameter part 603 via the expanded diameter part 603, the self-generation two fluids F are increased in speed (is accelerated) by passing through the rectifying part 604 of a tubular shape for guiding the fluids F toward the further downstream side due to the above-mentioned rapid volume expansion. The pressure of the self-generation two fluids F that reach the forward end part of nozzle 605 becomes equal to the pressure (P1) in a usage environment and the temperature becomes approximately equal to the boiling point (T1) at the pressure (P1).

FIG. 4 shows an example of measurement of the temperatures after being discharged from the forward end of the nozzle with regard to the self-generation two fluids F and the usual two fluids generated by using water of 100 degrees C. and nitrogen. It is recognized that the self-generation two fluids F obtain a higher temperature than the two fluids including water and nitrogen.

Next, the optimum nozzle shape of the cleaning nozzle 601 according to the embodiment will be explained.

Figure 16:
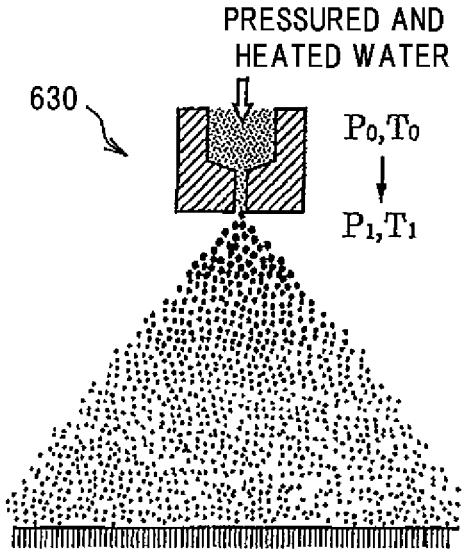
FIG. 16 is a cross-sectional view schematically explaining generation of the self-generation two fluids in case of using the conventional one fluid nozzle.

As described previously, the self-generation two fluids F can be generated by feeding only water, so that a one fluid nozzle on the market can be used as the cleaning nozzle 601. FIG. 16 shows a structure of the one fluid nozzle on the market.

Generally, the one fluid nozzle 630 often has a spray pattern of a fan-like shape or a conical shape in order to expand a spray range, for example, a nozzle manufactured by Spraying Systems Co., model number: HB-1/4-VV-SS-80-0050 has a spray pattern of a fan-like shape of almost 80 degrees. Due to this, the larger the distance from the forward end of the nozzle is, the more the spray pattern area is increased. Since the volumetric flow of the two fluids fed is almost constant, the larger the distance from the forward end of the nozzle is, the more the linear speed is lowered. In addition, as a result, the two fluids exchange heat with ambient air so that the temperature is lowered.

On the other hand, the cleaning nozzle 601 according to the embodiment includes the rectifying part 604 of an approximately straight tubular shape that has almost the same diameter as an outlet 606 of the cleaning nozzle 601 (refer to FIG. 14). Namely, in order to prevent the fact that the larger the distance from the forward end of the nozzle is, the more the spray pattern area is increased, the rectifying part 604 for preventing the spray pattern from being expanded is installed. By the above-mentioned function of the rectifying part 604, the decreases in linear speed and temperature can be prevented.

The inventors have further studied for clarifying an appropriate dimension of the cleaning nozzle 601. As a result, the appropriate dimension has been obtained as follows.

(1) The cleaning nozzle 601 includes a flow channel formed on the downstream side of the rectifying part 604 and simultaneously having a cross-section area smaller than the flow channel of the rectifying part 604 and has a shape of Laval nozzle whose cross-section area expands in the downstream direction gradually.

(2) The orifice part 602 has an inner diameter of not less than 0.2 mm and not more than 0.5 mm (3) The expanded diameter part 603 has an approximately conical shape and has an apex angle of not less than 60 degrees and not more than 150 degrees.

(4) The inner diameter of the rectifying part 604 has a relationship between the temperature of the feed water, and in case that water of not less than 140 degrees C. is fed, it is not more than 6 mm. It is preferable that a nozzle having the rectifying part 604 whose inner diameter is not more than 4 mm is used and water of not less than 130 degrees C. is fed. It is more preferable that a nozzle having the rectifying part 604 whose inner diameter is not more than 3 mm is used and water of not less than 120 degrees C. is fed. It is further more preferable that a nozzle having the rectifying part 604 whose inner diameter is not more than 2 mm is used and water of not less than 110 degrees C. is fed.

(5) The forward end part of nozzle 605 on the downstream side of the rectifying part 604 has a cross-section area equal to or smaller than the rectifying part 604.

Hereinafter, details until the optimum nozzle shape has been devised will be explained.

First, it is quantitatively explained that the pressured and heated water forms the two fluids in a manner of a self-generation.

First, an energy balance before and after the pressured and heated water is discharged from the cleaning nozzle 601 is represented as the following formula 1.

Formula 1

$$[A]+[B]=[C]+[D]+[E] \quad \text{(Formula 1)}$$

[A]: Kinetic energy before the discharge
[B]: Evaporative latent heat in accordance with the boiling
[C]: Kinetic energy after the discharge
[D]: Internal energy in accordance with decrease in temperature
[E]: Surface free energy in accordance with atomization Here, when an approximate value of each term is estimated on the condition that a flow rate before the discharge is 1 kg/min, heat energy is dominant, as shown in that [A]: Kinetic energy before the discharge=$8.7\times10^{-3}$ J/min, [C]: Kinetic energy after the discharge=$1.8\times10^{3}$ J/min, and Evaporative latent heat=$2.2\times10^{6}$ J/min. Consequently, the formula 1 is approximated by the following formula 2.

Formula 2

$$[B]=[D] \quad \text{(Formula 2)}$$

Figure 17:
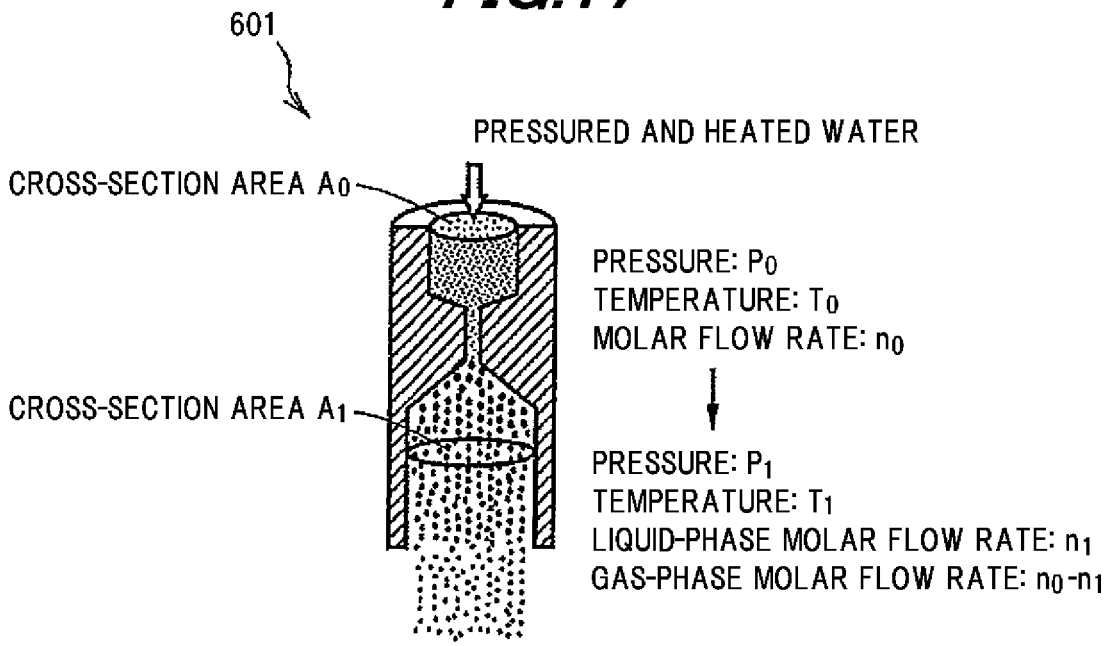
FIG. 17 is a cross-sectional view schematically showing parameters regarding a cleaning in which the self-generation two fluids is used.

[B]: Evaporative latent heat in accordance with the boiling
[D]: Internal energy in accordance with decrease in temperature A vaporization rate is calculated from the above-mentioned formula 2, as a result, a gas-liquid composition and a kinetic speed of the mist after the discharge can be calculated. By setting various parameters as shown in FIG. 17, and using the formula 2, how the gas-liquid composition and the kinetic speed of the mist after the discharge are varied to the temperature of the feed water has been calculated.

Figure 18:
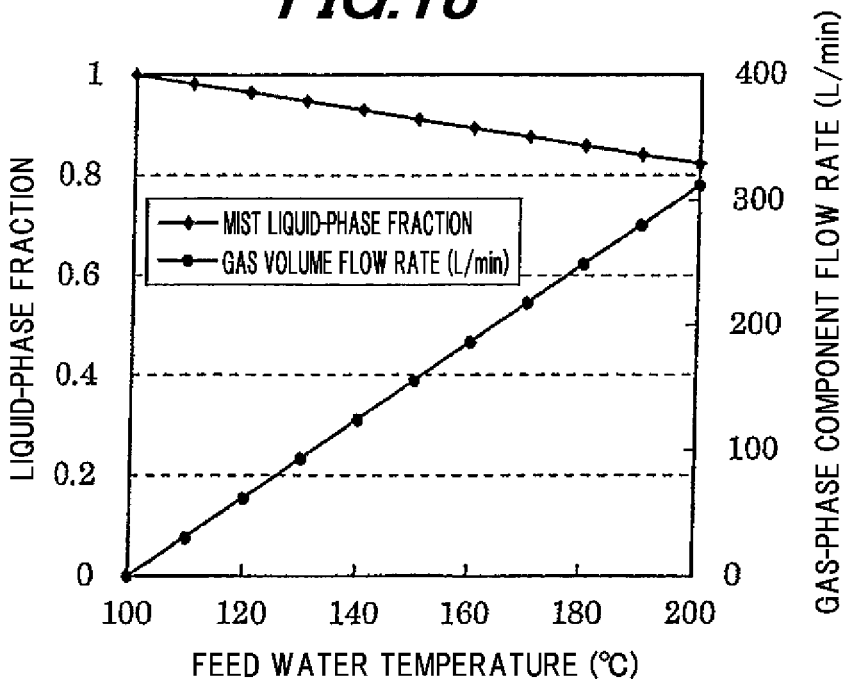
FIG. 18 is a graph showing relationships between a feed water temperature, and a liquid-phase fraction and a gas-phase component flow rate after the discharge.
Figure 19:
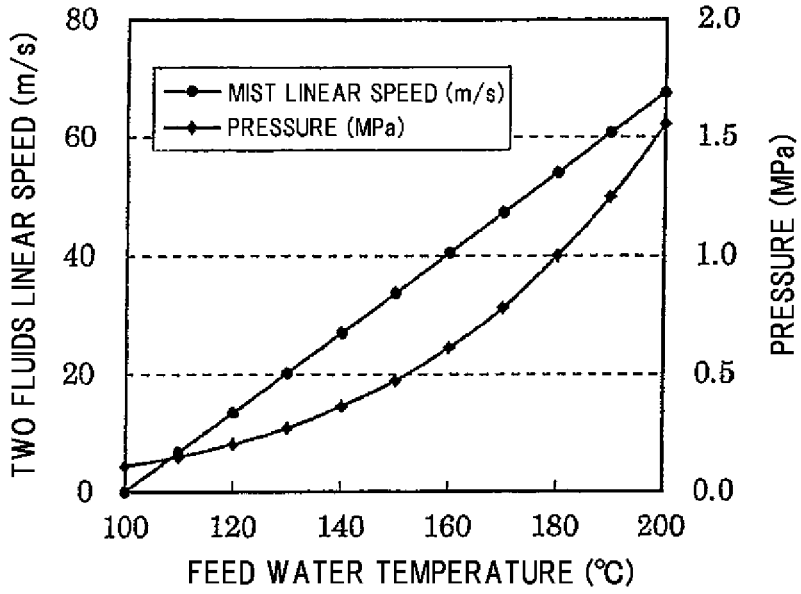
FIG. 19 is a graph showing relationships between a heated-pressured water (a feed water) temperature, and a pressure (a water vapor pressure) and a two fluids linear speed after the discharge (an inner diameter of the piping is 10 mm)

FIGS. 18 and 19 show the calculation result in case that the flow rate of the feed water is set to 1 l/min. A value obtained in case that a ratio of water, of water and water vapor constituting the generated two fluids, is represented based on molar number is defined as a liquid-phase fraction.

Figure 22:
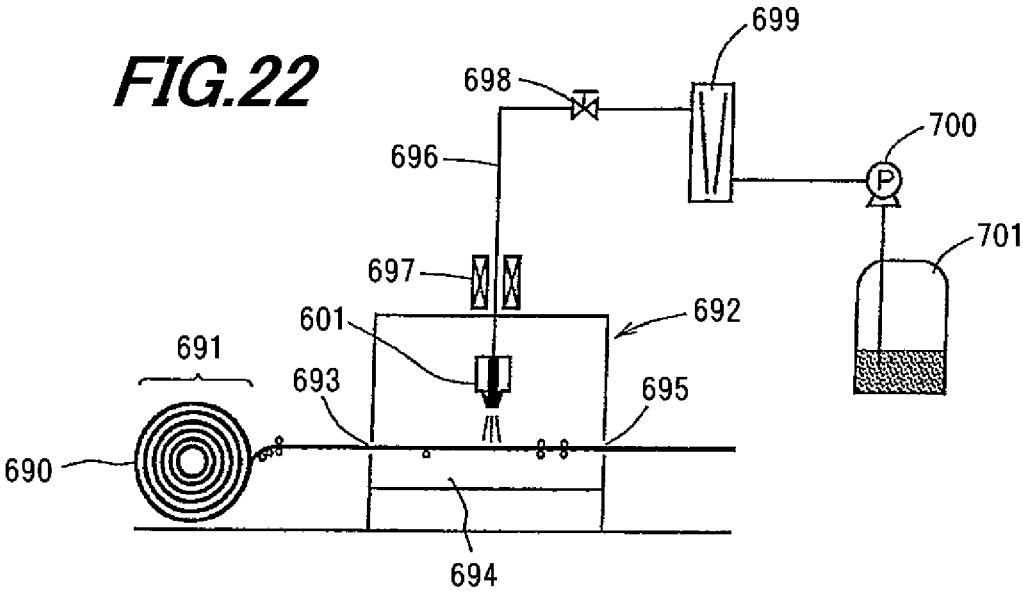
FIG. 22 is an explanatory view schematically showing a cleaning facility of the surface of the solid substance that uses the cleaning nozzle shown in FIG. 14.

As shown in FIG. 18, the liquid-phase fraction is lowered in accordance with increase of the temperature of the feed water, and it is about 0.9 at 150 degrees C., and is about 0.8 at 200 degrees C. At this time, the volume flow rate of the generated gas becomes 160 and 320 L/min respectively that satisfies an operation condition (several tens to several hundreds L/min) of usual two fluids cleaning. In addition, the linear speed of the generated two fluids (mist) becomes as shown in FIG. 19, and the speed of several tens m/sec can be obtained. Further, when the temperature of the pressured and heated water is varied, correspondingly, the vapor pressure is also varied as shown in FIG. 19. This shows that in case of using an equipment described below as shown in FIG. 22, the pressure in the tank is varied, and this means that in accordance with increase of the temperature of water, a liquid feed pressure is also increased. Further, the temperature of the feed water is a temperature that has been measured by a temperature measuring instrument located in the further upstream side than the orifice part 602 of the cleaning nozzle 601 and in the further downstream side than the heater.

Next, the optimum dimension of the rectifying part 604 will be explained.

As described above, in case that the conventional cleaning nozzle is used, the droplets are merely dripped from the pipe wall and a two fluids spray in which the mist is uniformly dispersed can not be obtained. The inventors have investigated the motion of the fluids and have concluded that the flow speed of the gas adjacent to the piping wall is insufficient to provide a kinetic momentum required for separating the droplets adhered to the piping wall.

Figure 20:
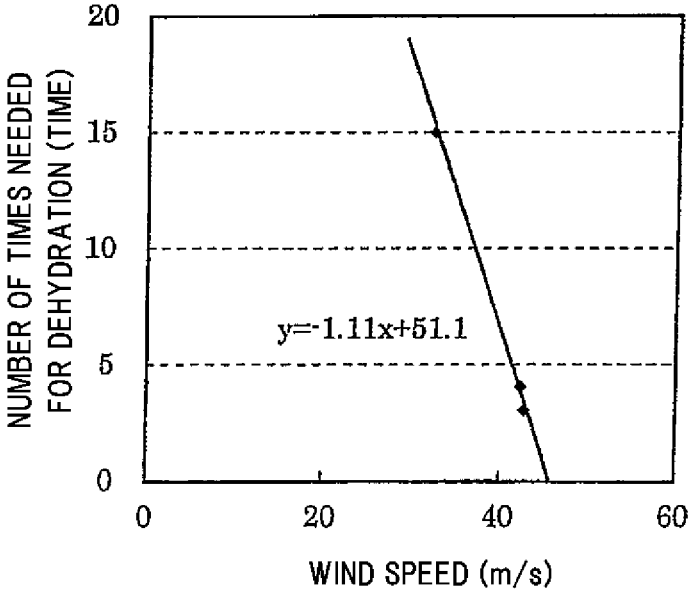
FIG. 20 is a graph showing relationships between a flow speed of airflow (a two fluids linear speed) and the number of times of spray needed for dehydration (the number of times of spray needed for removal of water droplet)

Then, in order to obtain the flow speed of the gas required for separating the droplets adhered to the piping wall, a model experiment was carried out, that a rotating disk located below an air blow was used, the droplets were adhered on the rotating disk, and how many times it was needed to pass through the location below the air blow so as to completely separate the droplets was measured to various flow speeds, and then a result shown in FIG. 20 was obtained. Namely, it has become clear that the flow speed of not less than 45 msec is required for separating the droplets by passing through the location below the air blow only one time.

The patent literature 4 discloses in paragraphs 0021 to 0029 that it is necessary to atomize the droplets that is moved on the internal wall of the nozzle by a gas flow, but it does not disclose the flow speed of the gas flow required for the atomization at all. Namely, the above-mentioned minimum flow speed has been clarified by investigation of the inventors for the first time.

Figure 21:
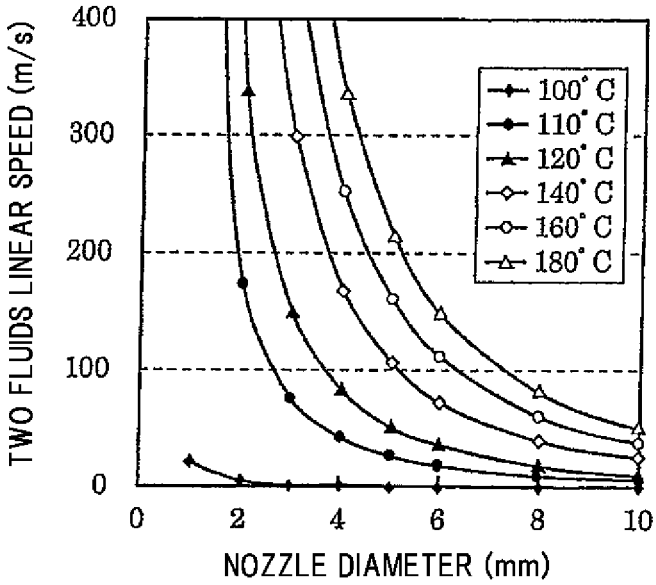
FIG. 21 is a graph showing relationships between a nozzle diameter and a linear speed of the self-generation two fluids generated, in the respective temperatures of the heated and pressured water.

Here, a trial for seeking what the flow speed of the self-generation two fluids F to be generated will be, correspondingly to various inner diameters of the piping and the temperature of the pressured and heated water to be fed, has been carried out and then a result shown in FIG. 21 has been obtained. Due to this, it has been clarified that for example, in order to obtain the flow speed of 45 m/s, the nozzle diameter is needed to be not more than 4 mm when the temperature of the pressured and heated water is 110 degrees C., the nozzle diameter is needed to be not more than 5 mm when the temperature of the pressured and heated water is 120 degrees C., and the nozzle diameter is needed to be not more than 10 mm when the temperature of the pressured and heated water is 160 degrees C.

Based on the above-mentioned investigation, prototype nozzles having various inner diameters have been manufactured and used for the experiment of the self-generation two fluids F. Table 2 shows a result that uniformity of the mist has been visually evaluated.

TABLE 2

| Inner Diameter | Temperature (degrees C.) | | | | |
|---|---|---|---|---|---|
| (mm) | 110 | 120 | 130 | 140 | 150 |
| 1 | ○ | ○ | ○ | ○ | ○ |
| 2 | ○ | ○ | ○ | ○ | ○ |
| 3 | Δ | ○ | ○ | ○ | ○ |
| 4 | Δ | Δ | ○ | ○ | ○ |
| 6 | x | x | Δ | ○ | ○ |
| 10 | x | x | x | x | x |

○: Mist is uniform.

Δ: Mist concentration has a distribution but dripping droplets are not generated.

x: Dripping droplets are generated.

According to this, it is recognized that if the temperature and the nozzle diameter are included within the above-mentioned temperature condition and nozzle diameter condition, dripping droplets are not generated. It is considered that the reason why a nonuniform state as shown in Table 2 as Δ is formed even if the condition is such that the flow speed of 45 m/s can be obtained from the FIG. 21 is that the flow speed of the self-generation two fluids F shown in FIG. 20 is an average flow speed, and a speed boundary layer is formed at a location adjacent to the piping wall so that the substantive speed is lowered, but it is understood that there is not so much of a difference between them in the sense of cleaning of the surface of solid substance.

Next, the optimum shape of the orifice part 602 will be explained.

The orifice part 602 has a function of adjusting a flow rate of a fluid that passes through the cleaning nozzle 601. If an inner diameter of the orifice part 602 is too small, a sufficient flow rate of the fluid can not be obtained, as a result, a sufficient cleaning power can not be obtained. On the other hand, if the inner diameter of the orifice part 602 is too large, the flow rate becomes excessive, so that a heater for heating is enlarged and energy consumption is increased.

As a result of investigation of the inventors, a discharge flow rate per one nozzle was 0.1 to 1.5 L/min when it was expressed in a flow rate of feed water (water before generating the self-generation two fluids F). As one method of feeding water to the cleaning nozzle 601, there is a method of using a pump, for example, as shown in FIG. 22. In addition, as another method, a method of utilizing a vapor pressure of heated water is conceivable. Based on that the feed liquid pressure is ranged in 0.2 to 2 MPa, the inventors have investigated the optimum shape of the orifice part 602 for obtaining the flow rate of 0.1 to 1.5 L/min at the pressure of 0.2 to 2 MPa, as a result, it has been found that it is preferable that the inner diameter is not less than 0.2 mm and not more than 0.5 mm.

Next, the optimum shape of the expanded diameter part 603 will be explained.

The expanded diameter part 603 is a region in which the inner diameter of the flow channel is moved from the inner diameter of the orifice part 602 to the inner diameter of the rectifying part 604. Here, when the inner diameter is drastically varied, stagnation of the flow is generated at the starting point of the rectifying part 604. Consequently, it is preferable that the inner diameter is gently varied from the orifice part 602 to the rectifying part 604. As a result of investigation of the inventors, it has been confirmed that it is preferable that an apex angle of the expanded diameter part 603 is included in a range of not less than 60 degrees and not more than 150 degrees.

Next, the optimum shape of the forward end part of nozzle 605 will be explained.

The forward end part of nozzle 605 is a region through which the self-generation two fluids F that have passed through the rectifying part 604 passes before discharged to the outside of the cleaning nozzle 601. As a result of investigation of the inventors, it has been clarified that if the forward end part of nozzle 605 has a cross-section area larger than the rectifying part 604 that is an acceleration part, after the self-generation two fluids F are discharged from the cleaning nozzle 601, for example, the self-generation two fluids F is diffused so as to be reduced in speed and the temperature is lowered, so that the cleaning power is damaged. Consequently, it is preferable that the forward end part of nozzle 605 has the cross-section area equal to or smaller than the rectifying part 604.

In addition, the reason why the shape of Laval nozzle is preferable is as follows.

In case that the forward end part of nozzle 605 has the shape of Laval nozzle, after the cross-section area of the flow channel is once reduced, it is gradually enlarged, from the rectifying part 604 to the flowing direction of the self-generation two fluids F. In accordance with this, the self-generation two fluids F are gradually expanded after they are compressed rapidly. In case of a usual gas such as a compressed air or usual gas-liquid two fluids in which droplets are accelerated by the usual gas, the fluid flow speed is further accelerated due to the fact that they are gradually expanded after they are compressed at the Laval nozzle part and the pressure is elevated. In case of the self-generation two fluids F according to the invention, when compressed at the Laval nozzle part, a part of water vapor that is a gas component is liquefied, and after that, the liquid is gradually expanded so as to be gasified again. As a result, distribution of droplets of the gas-liquid two fluids becomes uniform. The self-generation two fluids F are generated as described above, so that they can be made collide with the object to be cleaned at higher speed and higher cleaning power can be obtained.

Further, the patent literature 2 discloses a method that uses a nozzle having the Laval nozzle shape when a cleaning is carried out by using an ultrasonic fluid that is obtained by pressuring and discharging a cleaning liquid by a compressed air. However, the patent literature 2 does not disclose at all that the Laval nozzle shape is suitable for a nozzle of the self-generation that generates two fluids spontaneously by boiling heated and pressured water under ordinary pressure, and does not particularly disclose the above-mentioned behavior of the self-generation two fluids F in the Laval nozzle part in the invention. In addition, the "rectifying part" in the nozzle according to the invention is expressed as a "flow channel" in the nozzle of the patent literature 2, but the patent literature 2 does not disclose a structure on the upstream side of the flow channel not all, and does not disclose and suggest that the orifice part and expanded diameter part that have an appropriate shape are installed as the invention, so that the appropriate self-generation two fluids F can be obtained. The above-mentioned function and effect inherent in the invention has been clarified for the first time by investigation of the inventors.

To sum up the above, in accordance with the embodiment, the cleaning nozzle 601 that is capable of being heated up to a temperature at which a necessary cleaning power can be obtained, has a sufficiently high cleaning power to an extraneous matter on a surface of solid substance, and does not require a large facility in size for exhaust after the cleaning and is capable of completing the cleaning treatment in a short time, and further are capable of preventing a volatile organic compound (VOC) from being generated, so that a labor working environment can be improved and an influence on air pollution can be reduced can be provided.

Next, a cleaning method of a surface of a solid substance using the cleaning nozzle 601 according to the embodiment will be explained together with a cleaning device. Here, as one example, a cleaning method and a cleaning device of a copper strip will be explained.

As shown in FIG. 22, the copper strip 690 wound around the reel is fed from an uncoiler 691, is introduced into the inside of the surface treatment room 694 from an inlet 693 of the cleaning device 692, and is discharged from an outlet 695 to the outside of the surface treatment room 694.

The copper strip 690 introduced into the inside of the surface treatment room 694 is surface-treated by the cleaning nozzle 601 and a lubricating oil, a metal powder and the like adhered to the surface are removed.

In the surface treatment room 694, the cleaning nozzle 601 to which a pressured and heated water feed means is connected is installed. The pressured and heated water feed means has a piping 696 connected to the cleaning nozzle 601 and a water tank 701 connected to the piping 696 via a heater 697, a flow control valve 698, a flow meter 699, a pressure regulator and a pump 700. Here, the pump 700, the pressure regulator and the flow meter 699 are appropriately set to an appropriate value respectively, so that water can be pressured to a pressure not less than the pressure (P1) of the surface treatment room 694 that is a cleaning zone and heated. Further, the pressure can be also adjusted by feeding a liquid under pressure due to application of pressure based on a gas.

Water heated and pressured in this way generates the self-generation two fluids F by being discharged from the cleaning nozzle 601 as described above. The self-generation two fluids F generated in this way is brought contact into the surface of the copper strip 690, so that the cleaning treatment is applied to the surface of the copper strip 690.

The self-generation two fluids F discharged from the cleaning nozzle 601 remove the extraneous matter on the surface of the copper strip 690, and then are stored in a tray lowly-located (not shown) and are appropriately discharged from the tray. The self-generation two fluids F include approximately only water, so that an environmental load is small even if they are discharged into atmosphere.

Further, in the device, an exhaust blower (not shown) vacuums up air of the surface treatment room 694 and feeds air to an exhaust treatment facility (not shown).

Examples

Removal Experiment of Machining Oil

As Example 6, a removal experiment of machining oil was carried out by using a device shown in FIG. 22, and by using the self-generation two fluids F generated by using the cleaning nozzle 601. In addition, as Example 7, a removal experiment of machining oil was carried out by using a device shown in FIG. 22, and by using the self-generation two fluids F generated by using the cleaning nozzle 611.

Figure 23:
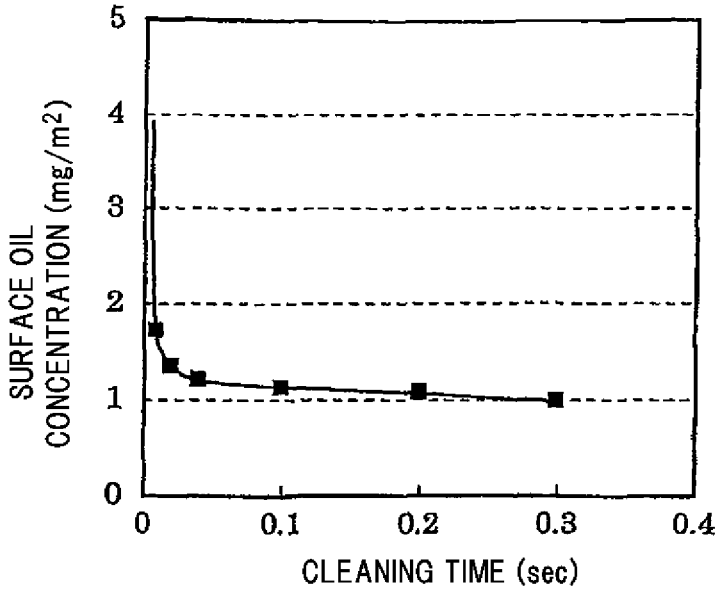
FIG. 23 is a graph showing relationships between a cleaning time and a surface oil concentration in the cleaning nozzle 601 shown in FIG. 14.

As an object to be cleaned, a copper strip after roll processing to whose surface 200 mg/m$^2$ of an oily contamination are adhered was used. Four nozzles were arranged in a direction perpendicular to the running direction of the copper strip and on the same axis, and a spray pattern of almost 10 mm×40 mm was formed. A cleaning region length of the running direction of the copper strip was set to almost 10 mm and the running speed of the copper strip was set to 60 m/min, so that the cleaning time was 0.01 second. The temperature of the feed water was set to 145 degrees C. and it was fed under pressure by using a pressure of water vapor without feeding a gas from the outside. At the time, the feed pressure was 0.45 MPa and a volume flow rate of the feed water per one cleaning nozzle was 0.25 L/min. FIG. 23 shows a result after the cleaning.

In accordance with the result, it is recognized that a surface oil concentration is lowered corresponding to the cleaning time. Further, in the Example, four nozzles were arranged in a direction perpendicular to the running direction of the copper strip and on the same axis, but not limited to this, they can be also arranged in a zigzag shape.

Next, as Comparative Example 2, an experiment using a one fluid nozzle on the market manufactured by Spraying Systems Co., model number: HB-1/4-VV-SS-80-0050 was carried out. Table 3 shows results of Comparative Example 2 together with Example 6.

TABLE 3

| Item | Nozzle | | | | | Residual oil |
|---|---|---|---|---|---|---|
| | Summary | Orifice part | Expanded diameter part | Rectifying part | Forward end part of nozzle | concentration* ($mg/m^2$) |
| Example 6 | Nozzle of the embodiment | Inner diameter (0.5 mm) | Apex angle (118 degrees) | Inner diameter (4 mm) Length (50 mm) | The same cross-section shape as rectifying part | 1.6 (Acceptable) |
| Example 7 | Nozzle of another embodiment | Inner diameter (0.5 mm) | Apex angle (118 degrees) | Inner diameter (4 mm) Length (50 mm) | Laval nozzle | 0.6 (Acceptable) |
| Comparative Example 2 | One fluid nozzle | Inner diameter (0.46 mm) | None** | None | None | 3.2 (Not acceptable) |

Cleaning time: 0.01 sec

*Target: not more than 3

**Nozzle of Comparative Example 2 has a slot formed on the forward end part thereof so as to form a flat pattern.

From Table 3, it is recognized that the cleaning nozzle 601 according to invention is excellent. In addition, it is clear that when the cleaning nozzle 611 is used, more preferable result can be obtained.

Removal Test of Foreign Substance

As Example 8, a removal test of foreign substance was carried out by using a device shown in FIG. 22, and by using the self-generation two fluids F generated by using the cleaning nozzle 601.

As Example 9, a removal test of foreign substance was carried out by using a device shown in FIG. 22, and by using the self-generation two fluids F generated by using the cleaning nozzle 611.

As an object to be cleaned, a copper foil to which a slit processing was applied and in which there were approximate 800 foreign substances per $m^2$ of not less than 50 μm was used.

As Comparative Example 3, the cleaning was carried out by using a two fluids nozzle on the market manufactured by Spraying Systems Co., model number: B-1/4JBC-SS and by generating two fluids including nitrogen gas and water.

An evaluation of the invention was carried out based on the number of the foreign substance remaining after the cleaning and an amount of exhaust required for preventing the mist from the cleaning device from being leaked to working environment. The smaller the amount of exhaust required is, the smaller the energy required for the exhaust becomes, so that it is preferable in manufacturing.

The results are as shown in Table 4.

The number of foreign substance remaining was acceptable in every nozzle. In particular, the Laval nozzle is used, so that the number of foreign substance can be further reduced. In addition, in cases of using the cleaning nozzles 601, 611, the amount of exhaust required was reduced to approximate 1/40, so that it is clear that the cleaning nozzles 601, 611 according to the invention are excellent.

From the above-mentioned results, it is understood that in accordance with the cleaning nozzle 601 according to the invention, foreign substance-like contamination can be also removed, and then in a cutting work product, processing powder and processing oil can be removed simultaneously, so that advantages such as aggregation and downsizing of equipments, enhancement of investment efficiency can be provided.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A surface treatment method of a metal member, comprising:

elevating a pressure of a liquid water to a first pressure, the first pressure being more than a second pressure, heating the liquid water to a temperature of more than a boiling point at the second pressure and less than a boiling point at the first pressure, wherein upon discharge of the liquid

TABLE 4

| Item | Nozzle | | | | | Number of foreign substance* ($1/m^2$) | Amount of exhaust** ($m^2/min$) |
|---|---|---|---|---|---|---|---|
| | Summary | Orifice part | Expanded diameter part | Rectifying part | Forward end part of nozzle | | |
| Example 8 | Nozzle of the embodiment | Inner diameter (0.5 mm) | Apex angle (118 degrees) | Inner diameter (3 mm) Length (100 mm) | The same cross-section shape as rectifying part | 32 (Acceptable) | 1.2 (Acceptable) |
| Example 9 | Nozzle of another embodiment | Inner diameter (0.5 mm) | Apex angle (118 degrees) | Inner diameter (3 mm) Length (100 mm) | Laval nozzle | 17 (Acceptable) | 1.2 (Acceptable) |
| Comparative Example 3 | Two fluids nozzle | Inner diameter (0.46 mm) | None*** | None | None | 54 (Acceptable) | 52 (Not acceptable) |

Cleaning time: 0.01 sec

*Target: not more than 100

**Target: not more than 10

***Nozzle of Comparative Example 3 has a slot formed on the forward end part thereof so as to form a flat pattern.

water into an environment at the second pressure a two phase flow is formed, wherein the two phase flow comprises a gas phase and a liquid phase, and contacting the metal member with the two phase flow to remove an oily substance on the metal member.

2. The surface treatment method of a metal member according to claim 1, wherein the heated and pressured water has a pressure of not more than 0.45 MPa.

3. The surface treatment method of a metal member according to claim 1, wherein the two phase flow is formed of water vapor and water liquid and the water liquid has a droplet diameter of 1 μm to 100 μm.

4. A cleaning method of a surface of a solid substance, comprising:

cleaning the surface of the solid substance by contacting the surface with a two phase flow, wherein the two phase flow comprises a gas phase and a liquid phase, generated by a cleaning nozzle, the two phase flow obtained by:

elevating a pressure of a liquid water to a first pressure, the first pressure being more than a second pressure, heating the liquid water to a temperature of more than a boiling point at the second pressure and less than a boiling point at the first pressure, wherein upon discharge of the liquid water from the nozzle into an environment at the second pressure, the two phase flow is formed, the cleaning nozzle comprising:

an orifice part comprising a flow channel for controlling a flow rate of the heated and pressured water;

an expanded diameter part formed on a downstream side of the orifice part, for expanding a cross-sectional area of the flow channel of the orifice part and generating the two phase flow; and a rectifying part comprising a flow channel formed on the downstream side of the expanded diameter part and simultaneously having a cross-sectional area larger than the flow channel of the orifice part.

5. The cleaning method according to claim 4, wherein the two phase flow has a wind speed of not less than 45 m/s.

6. The cleaning method according to claim 4, wherein the heated and pressured water has a temperature of not more than 120 degrees C., and the rectifying part has an inner diameter of not more than 4 mm.

7. The cleaning method according to claim 4, wherein the heated and pressured water has a temperature of more than 120 degrees C., and the rectifying part has an inner diameter of not more than 6 mm.

8. The cleaning method according to claim 4, wherein the solid substance comprises a copper wire or a copper strip.

* * * * *